US006717526B2

(12) United States Patent
Martineau et al.

(10) Patent No.: US 6,717,526 B2
(45) Date of Patent: Apr. 6, 2004

(54) LIGHT DEGRADATION SENSING LED SIGNAL WITH LIGHT PIPE COLLECTOR

(75) Inventors: Patrick Martineau, Montréal (CA); Jean-Simon Bourgault, Montréal (CA); Eden Dubuc, Saint Edouard de Napierville (CA)

(73) Assignee: Gelcore LLC, Valley View, OH (US)

( * ) Notice: Subject to any disclaimer, the term of this patent is extended or adjusted under 35 U.S.C. 154(b) by 31 days.

(21) Appl. No.: 09/827,429

(22) Filed: Apr. 6, 2001

(65) Prior Publication Data

US 2002/0089420 A1 Jul. 11, 2002

Related U.S. Application Data

(63) Continuation-in-part of application No. 09/756,670, filed on Jan. 10, 2001, now Pat. No. 6,509,840.

(51) Int. Cl.[7] ..... G08B 5/22

(52) U.S. Cl. ..... 340/815.45; 340/907; 362/800

(58) Field of Search ..... 340/815.45, 907, 340/931, 641, 642; 315/119, 121, 122, 76; 362/800, 217, 219, 223, 225

(56) References Cited

U.S. PATENT DOCUMENTS

| | | | | | |
|---|---|---|---|---|---|
| 4,254,453 | A | | 3/1981 | Mouyard et al. | 362/240 |
| 4,271,408 | A | | 6/1981 | Teshima et al. | 345/83 |
| 4,733,335 | A | * | 3/1988 | Serizawa et al. | 362/800 X |
| 5,140,220 | A | | 8/1992 | Hasegawa | 362/800 X |
| 5,243,326 | A | * | 9/1993 | Disabato | 340/555 |
| 5,343,330 | A | | 8/1994 | Hoffman et al. | 359/708 |
| 5,663,719 | A | * | 9/1997 | Deese et al. | 362/800 X |
| 5,704,709 | A | | 1/1998 | Zwick et al. | 362/304 |
| 5,887,968 | A | | 3/1999 | Logan | 362/241 |
| 6,019,493 | A | * | 2/2000 | Kuo et al. | 362/800 |
| 6,236,331 | B1 | * | 5/2001 | Dussureault | 340/815.45 |
| 6,268,801 | B1 | * | 7/2001 | Wu | 340/815.45 |
| 6,283,613 | B1 | * | 9/2001 | Schaffer | 362/800 X |
| 6,509,840 | B2 | * | 1/2003 | Martineau | 340/815.45 |

* cited by examiner

*Primary Examiner*—Thomas Mullen
(74) *Attorney, Agent, or Firm*—Orum & Roth

(57) ABSTRACT

An LED signal with an LED light pipe collector and intelligent light degradation sensor. The light pipe collector captures LED light normally lost in a generally horizontal direction and redirects it into a generally vertical direction through use of total internal reflection. The light degradation sensor monitors LED signal light output. When light output degrades to a preset level, an electrical circuit triggers a disabling short circuit to deactivate the LED signal.

50 Claims, 22 Drawing Sheets

LIGHT DEGRADATION SENSING LED SIGNAL WITH LIGHT PIPE COLLECTOR

This is a continuation in part of U.S. patent application Ser. No. 09/756,670 filed Jan. 10, 2001, now U.S. Pat. No. 6,509,840.

BACKGROUND OF THE INVENTION

1. Field of the Invention

The present invention relates to signals, in particular, Light Emitting Diode (LED) Signals. More specifically, the present invention relates to an LED traffic signal that is less susceptible to the "sun phantom" effect, having an improved viewing aspect and a LED light output degradation sensing circuit and light pipe collector, as well as materials, manufacturing and installation cost advantages.

2. Description of the Related Art

LED traffic signals present numerous advantages over common incandescent lamp traffic signals. Use of LEDs provides a power consumption savings and extremely long life in comparison to common incandescent light sources. The long life span creates improved reliability and sharply lowered maintenance costs.

As an individual LED is not bright enough to equal the light output of an incandescent lamp, multiple LEDs are used. Previously, multiple LEDs created a display aspect with multiple individual points of light readily discernible by the viewer. A non-uniform display aspect is commercially undesirable for traffic signals. One method of preventing discernable individual light points has been to use a full array of LEDs. However this is not commercially competitive as each additional LED is a significant percentage of the signals total cost. Each generation of LEDs is becoming brighter and brighter requiring fewer and fewer LEDs to equal the light output of an incandescent lamp but at the same time increasing the likelihood that the individual point sources and/or shadows between each LED are then detectable by the viewer.

Common LEDs include a semiconductor diode pellet located above a cup shaped reflector incased in a barrel shaped epoxy housing with a lens formed in its top. The LED lens and the reflector cooperate to direct approximately 65% of the light emitted by the diode through the lens shaped top end in a vertically directed wide conical light distribution pattern. The remaining 35% of light emitted by the diode is unusable as it is radiated at angles ranging between just outside of the forward conical light distribution pattern and horizontally through the sides of the LED housing.

Attempts to recover and utilize the horizontally radiated light have included mirrored reflectors and/or mirrored optical receiving bodies with mirror coatings on their outside surfaces, thereby creating a parabolic reflector that captures and redirects the horizontal light. Unfortunately, these solutions add more cost than merely adding additional LEDs to make up for the unutilized light. Solutions directed to modifying each individual LED with its own reflector add an additional manufacturing cost to each and every LED. Further, the past solutions for multiple LED embodiments have been tied to a fixed set of LEDs. As LED efficiency increases, the required number of LEDs for a given light output decreases. With each new generation of higher efficiency LEDs, the past solutions require the redesign and remanufacture of the mirrored reflectors, adding further costs to the final product.

Total internal reflection is a phenomenon where electromagnetic radiation (light) in a given medium (for example acrylic or polycarbonate material) incident on the boundary with a less dense medium (for example air), at an angle equal to or larger than the critical angle, is completely reflected from the boundary. Commonly used in fiber optics technology and binocular prisms, properly designed optical components using total internal reflection do not require expensive mirrored surfaces to redirect light. Total internal reflection is described in detail in "Modern Optical Engineering" Library of Congress Catalog Card Number 66-18214, hereby incorporated by reference. Applicant is unaware of previous application of total internal reflection as a means for collecting and redirecting horizontal light "lost" from a common LED.

Due to the large installed base, worldwide, of incandescent traffic signal systems, most LED traffic signals are designed to be retrofitted into existing traffic signal systems originally designed for incandescent lamps. To allow an easy retrofit to an LED light source, without requiring large changes to existing intersection alternating current power distribution and logic circuits, signal assemblies incorporate a power supply to drive LEDs at a lower, controlled, direct current power level. In the past, this has resulted in an LED traffic signal assembly with a separate power supply built on a Printed Circuit Board (PCB) and a separate LED matrix PCB connected via wiring between the two PCB's as well as spliced into the original incandescent power wiring. Integration of LEDs onto a single PCB including the power supply results in a smaller PCB with corresponding manufacturing and cost of materials benefits.

Cost of materials and assembly time contribute to total cost and therefore to commercial success. Previous LED traffic signals used a large number of total components, each individual component adding material cost, assembly cost and introducing a potential quality control, moisture, and/or vibration failure opportunity.

Traffic signals are susceptible to "sun phantom" phenomena. When a light source, for example the sun, shines upon the face of a traffic signal, a bright spot, or worse, internal reflection from within the signal, may make it appear to a viewer that the signal is energized when, in fact, it is not, leading to an increased chance for accidents.

Previous incandescent signals have attempted to prevent the "sun phantom" phenomena by using a visor, internal or external baffles and/or a flat outer face angled towards the ground. Visors and external baffles limit the viewing angle of the signal. Internal baffles add cost to the signal by introducing an element that has no other purpose. Flat outer faces are not allowed, according to some traffic signal specifications which require a spherical front element.

Previous LED signal lamps are especially susceptible to "sun phantom" phenomena because the rear surface of each LED is highly reflective. Previous LED signal designs located the LEDs on or close to the outer surface where the rear surface of each LED could easily be reached by stray light, creating an increased opportunity for "sun phantom" reflections. Previous LED signals that use a secondary optical element between the LEDs and the outer cover also suffer from sun phantom effect as the stray light reflects back, generally along the center axis, rather than towards the ground, off of the optical element.

LED signals have an extremely long service life that has increased with each new generation of LEDs. Incandescent lamps, while having a much shorter service life, have relatively constant light output until a total failure occurs, i.e. burnout of the light filament. LED signals, over an extended period, have gradually diminishing light output.

Further, LED light output is negatively affected by temperature. In extreme climate or during unnaturally warm periods LED light output diminishes during the day and then returns to a normal level during cooler periods at night.

Because of the difficulty, time and expense of accurately determining when an LED signal has permanently dropped below the acceptable light output limit, it is customary for consumers to automatically replace LED signals upon expiration of the warranty (for example, five years). This may result in years of useful service life being unnecessarily wasted, reducing the cost effectiveness of using LED signals.

U.S. patent application Ser. No. 09/543,240, now abandoned incorporated herein by reference, discloses monitoring circuits for an LED signal that shut off the signal if the power supply or LED arrays change their voltage and/or current characteristics. Unfortunately, LED light output may degrade without a change in the LED signal's voltage or current characteristics.

Therefore, the present invention has the following objectives:

1. An LED signal which minimizes the problem of "sun phantom" erroneous signal aspects.
2. An LED signal which presents a uniform brightness display aspect equal to or better than a common incandescent lamp traffic signal.
3. An LED signal that has materials and manufacturing assembly cost advantages.
4. An LED signal comprised of a single printed circuit board carrying both the LEDs and the power supply components.
5. An LED signal retro-fitable into existing incandescent traffic signals, without requiring removal of the existing reflector assembly.
6. An LED signal capable of easy upgrade to higher output LEDs without requiring recalculation of the optical elements.
7. An LED signal with a display aspect unaffected by changes in individual LED light output.
8. An LED signal usable in multiple configurations, each specific to a given application, with a minimum of unique components being required.
9. A cost efficient apparatus for capturing and utilizing horizontal light emissions from common LEDs.
10. A cost efficient apparatus for capturing and utilizing horizontal light emissions from common LEDs, useable with a variable number of LEDs.
11. A cost efficient apparatus for creating a controlled light emission pattern with minimal optical materials cost.
12. A cost effective and automatic means for detecting when an LED signal's light output has fallen below an acceptable level.

Further objects will be realized by one skilled in the art, through review of the following description and appended claims.

SUMMARY OF THE INVENTION

The above objects and other advantages are achieved with the present invention. Placement of the LEDs, to create an overlapping light emission pattern at an increased distance from a Multiple Collimating Zone Element (MCZE) creates a uniform display aspect for the signal, without individual points of light. The increased distance also allows placement of power supply components and circuitry on a single PCB with the LEDs, spaced so as to prevent interference with the LED light.

A light pipe collector (LPC) for LED signals captures and redirects normally unutilized horizontally emitted LED light. Designed for total internal reflection, the LPC redirects horizontally emitted light without the use of mirrored surfaces or reflective coatings. A single LPC may be snap fit to the PCB over a group of several LEDs. As the light output of LEDs increases with each new generation the same LPC may be used with fewer LEDs without requiring redesign and/or remanufacture.

When designed with a side to side dimension in close tolerance with the external dimension of the LEDs, the LPC also assists in properly orienting LEDs that may be misaligned due to imperfections in the LEDs' housings or poor assembly. The LPC may be designed to provide an optical solution that eliminates or minimizes the need for additional optics in the LED signal. Formed into directional arrows or letters the LPC creates an LED signal with a minimal number of LEDs without requiring other optics. The LPC creates an LED signal with materials, manufacturing and operating cost efficiencies previously unavailable.

The "sun phantom" phenomena is prevented by a large radius spherical outer distribution cover, angled to reflect stray light away from the viewer, towards the ground. A complex inner surface on the distribution cover creates a shaped light distribution, focused upon the viewer, while at the same time further directing stray light reflections, again, towards the ground.

A light sensor, mounted within an LED signal housing senses the LED light output level. When the light level falls below a preset level, a short circuit is created that breaks a fusible link on the input power line. The broken fusible link disables the LED signal thereby alerting users that replacement is necessary.

Materials, assembly and installation cost efficiencies are also realized by a novel snap together housing design which adds to an overall reduction in total number of components. The signal fits into existing standard incandescent traffic signals upon removal only of the incandescent bulb and original outer lens. Electrical connection is made by merely screwing a socket mating connector into the existing incandescent socket.

DETAILED DESCRIPTION

Figure 1:
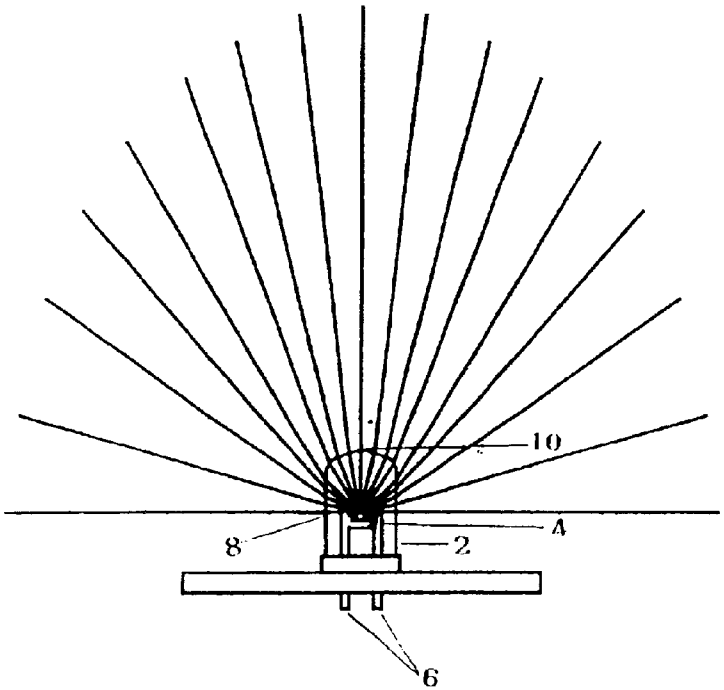
FIG. 1 is a side view of a common 5 mm LED showing a typical light output distribution.

As shown in FIG. 1, a common 5 mm barrel shaped LED 1 has a diode semiconductor pellet 8 positioned in an epoxy housing 2 between a lens/dome 10 and a cup shaped reflector 4 formed at the end of one of two electrical leads 6. The cup shaped reflector 4 and lens/dome 10 cooperate to direct approximately 65% of the LED's light output into a wide conical shaped distribution pattern in the vertical direction. The remaining 35% of the LED's light is unusable, radiated 360° at angles ranging from just outside the wide conical shaped distribution pattern and in a generally horizontal direction.

Figure 3:
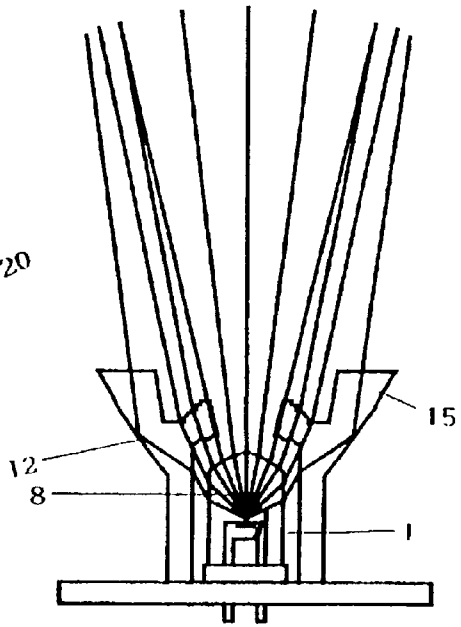
FIG. 3 is another embodiment of a light pipe shown in FIG. 2. This embodiment does not have a dome lens directly above the LED.
Figure 2:
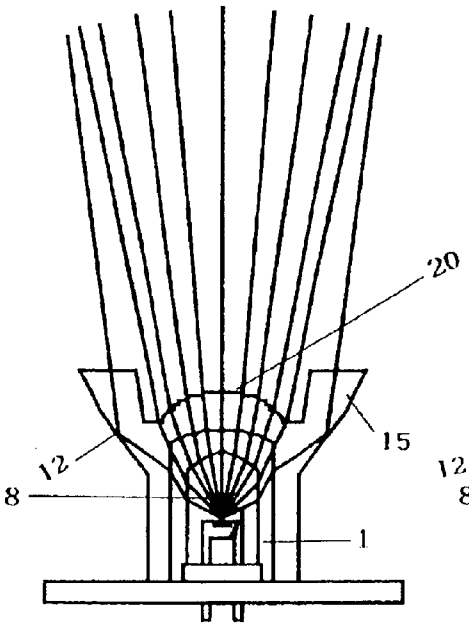
FIG. 2 is a side view of a common LED with a LPC redirecting the light into a forward direction.

An LPC 15, as shown in FIGS. 2 and 3, may be used to maximize the utilization of all light emitted by the LED 1. The LPC, made of a transparent or colored plastic, acrylic or polycarbonate material is designed to use total internal reflection to reflect light emitted by the LED 1 in the horizontal direction into the vertical direction.

Figures 23A, 23B:
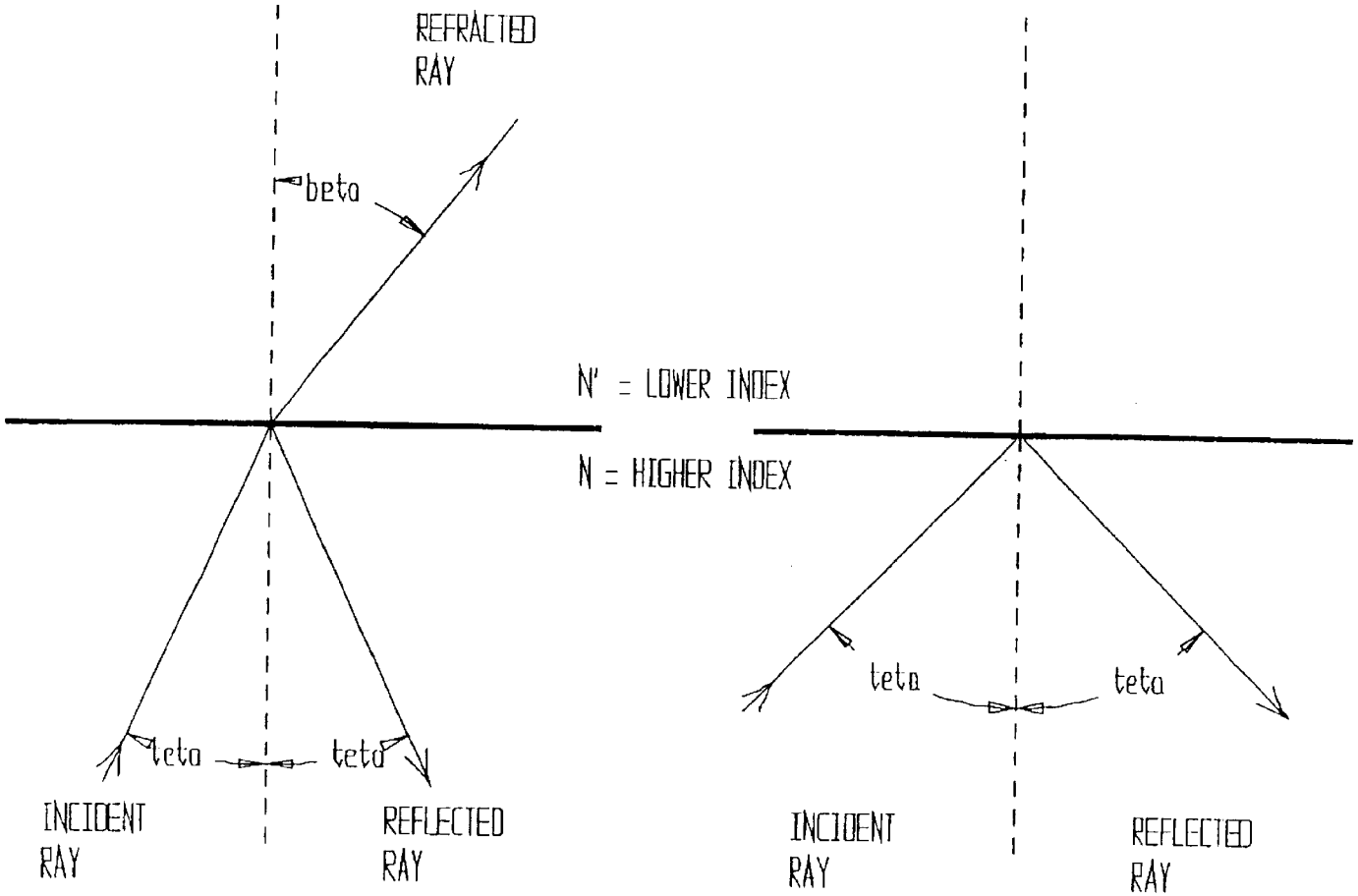
FIG. 23A is a diagram showing common light refraction/reflection.
FIG. 23B is a diagram showing total internal reflection.
Figure 24:
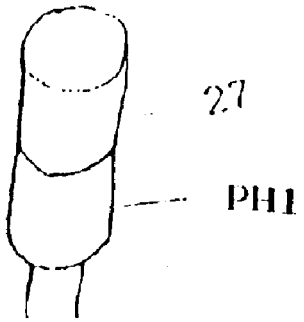
FIG. 24 is a schematic view of a baffle, shroud or blinder for the light sensor.
Figure 25:
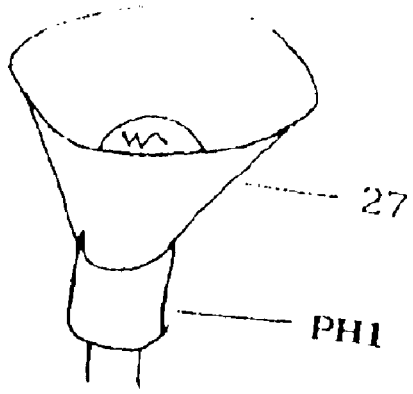
FIG. 25 is another embodiment of the baffle, shroud or blinder of FIG. 24.
Figure 26:
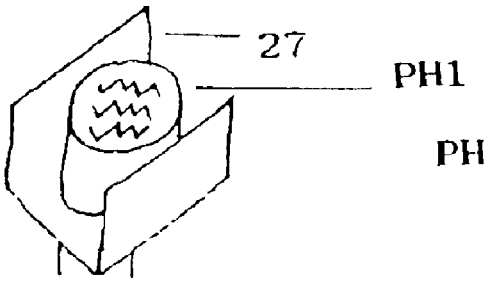
FIG. 26 is another embodiment of the baffle, shroud or blinder of FIG. 24.
Figure 27:
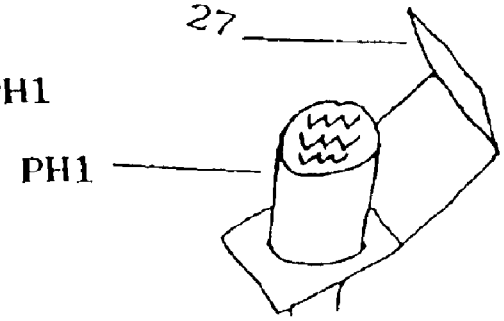
FIG. 27 is another embodiment of the baffle, shroud or blinder of FIG. 24.

As shown in FIG. 23A, an incident ray at an angle teta to the normal passing from a higher index of refraction medium creates a refracted ray at an angle beta to the normal and a reflected ray at an angle teta to the normal. As the incident ray angle teta with respect to the normal increases, the refraction angle beta increases faster, according to Snell's Law: sin(beta)=(N/N') sin(teta). As shown in FIG. 23B, assuming the boundary is smooth and clean, when the incident ray angle teta to the normal increases to the critical angle (the point the refraction angle beta is 90°) and/or greater, there is no refraction ray, only a 100% reflection ray at an angle teta to the normal.

For example purposes, polycarbonate material has an index of refraction of 1.59. As long as the reflection surface 12 is designed to be at a critical angle of 38.9° or more with respect to the incident ray emitted by the light source (diode semiconductor pellet 8) and the outer surface of the reflection surface 12 is surrounded by air, or other medium less dense than air, total internal reflection will occur. Total internal reflection removes any requirement that the reflector surfaces be mirror coated, reducing manufacturing costs.

The recovery of unused light by the LPC 15 allows fewer LEDs 1 to be used to create the same amount of signal light output. The LPC 15 pays for its added materials cost by eliminating LEDs 1 otherwise required. Using fewer LEDs 1 reduces the operating energy consumption of the LED signal.

The LPC 15 can be designed to spread and/or focus the light. In the embodiment shown in FIG. 2, an optical dome 20 may be used to redirect the LEDs main light output. The dome 20 assists in creation of a narrower, well defined, light emission pattern useful for—associating a specific LED or group of LEDs with a specific collimating zone or other optical element having a specific amount of overlap with neighboring collimating zones or other optical elements.

Figure 6:
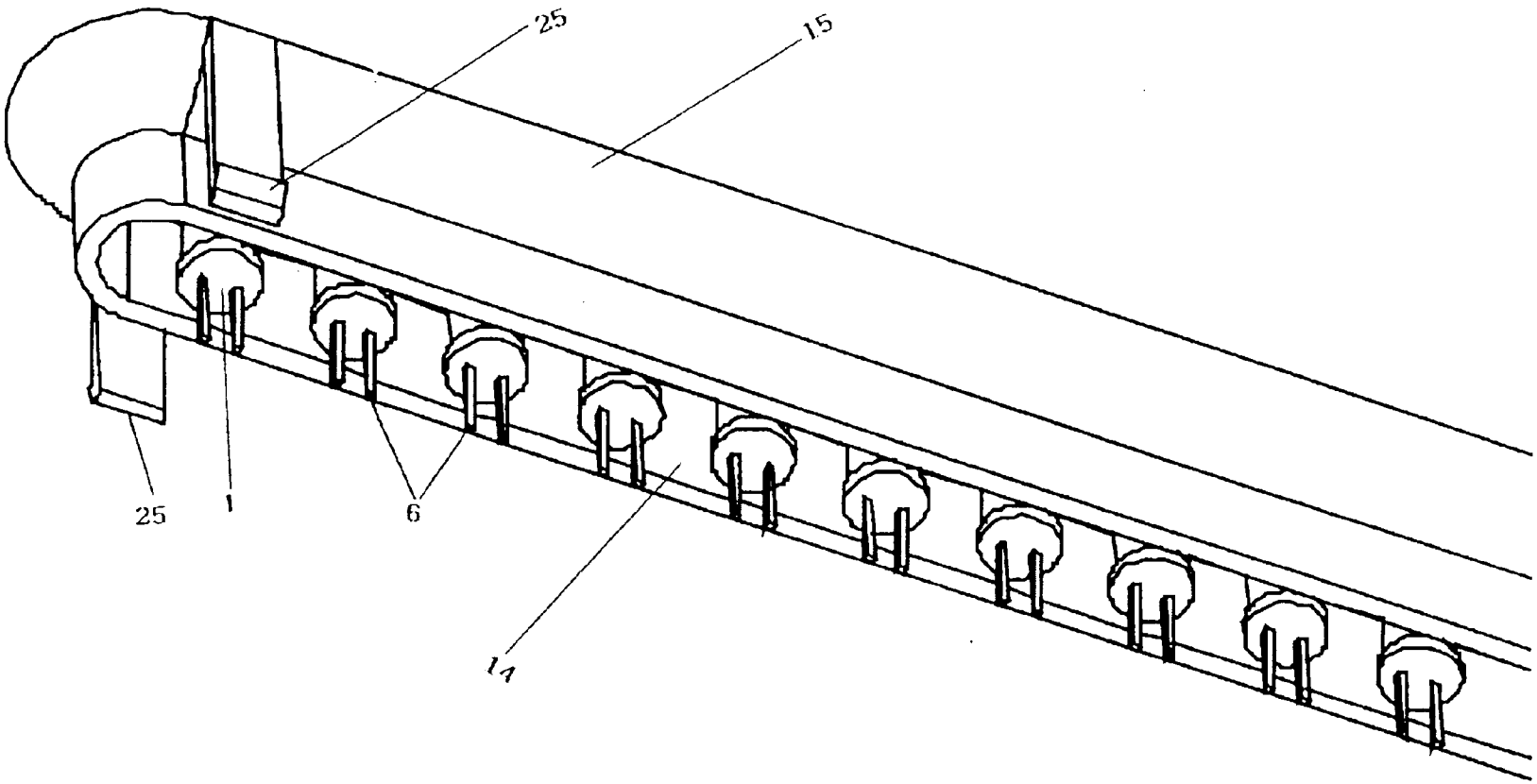
FIG. 6 is a partial isometric schematic view of a LPC viewed from below showing LEDs within the channel.
Figure 8A:
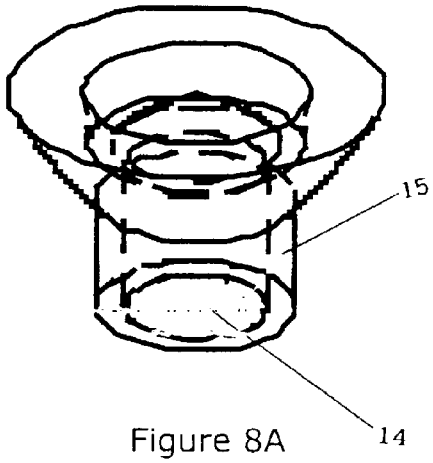
FIG. 8*a* is a schematic view of a LPC configured for a cluster of one or more LEDs.
Figure 8B:
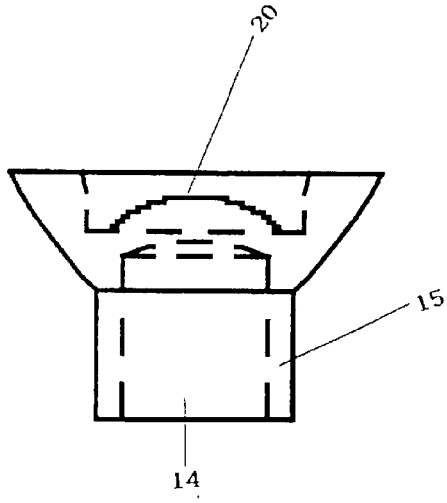
FIG. 8*b* is a side view of the LPC of FIG. 8*a*.

The LPC 15 may be designed for use with a single LED 1 as shown in FIGS. 8*a* and 8*b*. However, depending on the light requirements of the LED signal's specific application and the light available from an individual LED 1, multiple LEDs 1 may be required. FIG. 6 shows an LPC 15 designed to fit over multiple LEDs arranged in a linear configuration. A receiving chamber 14 in a slot configuration is sized to accept the LEDs 1 along its length. The receiving chamber 14 also acts to align the LEDs, aligning them in a common orientation despite errors in LED placement with respect to the PCB, extra housing epoxy on the leads 6 or other alignment errors. Properly oriented LEDs, directing the light as intended by the LED signal's optical design solution creates a bright and uniform display aspect for the signal.

Figure 7:
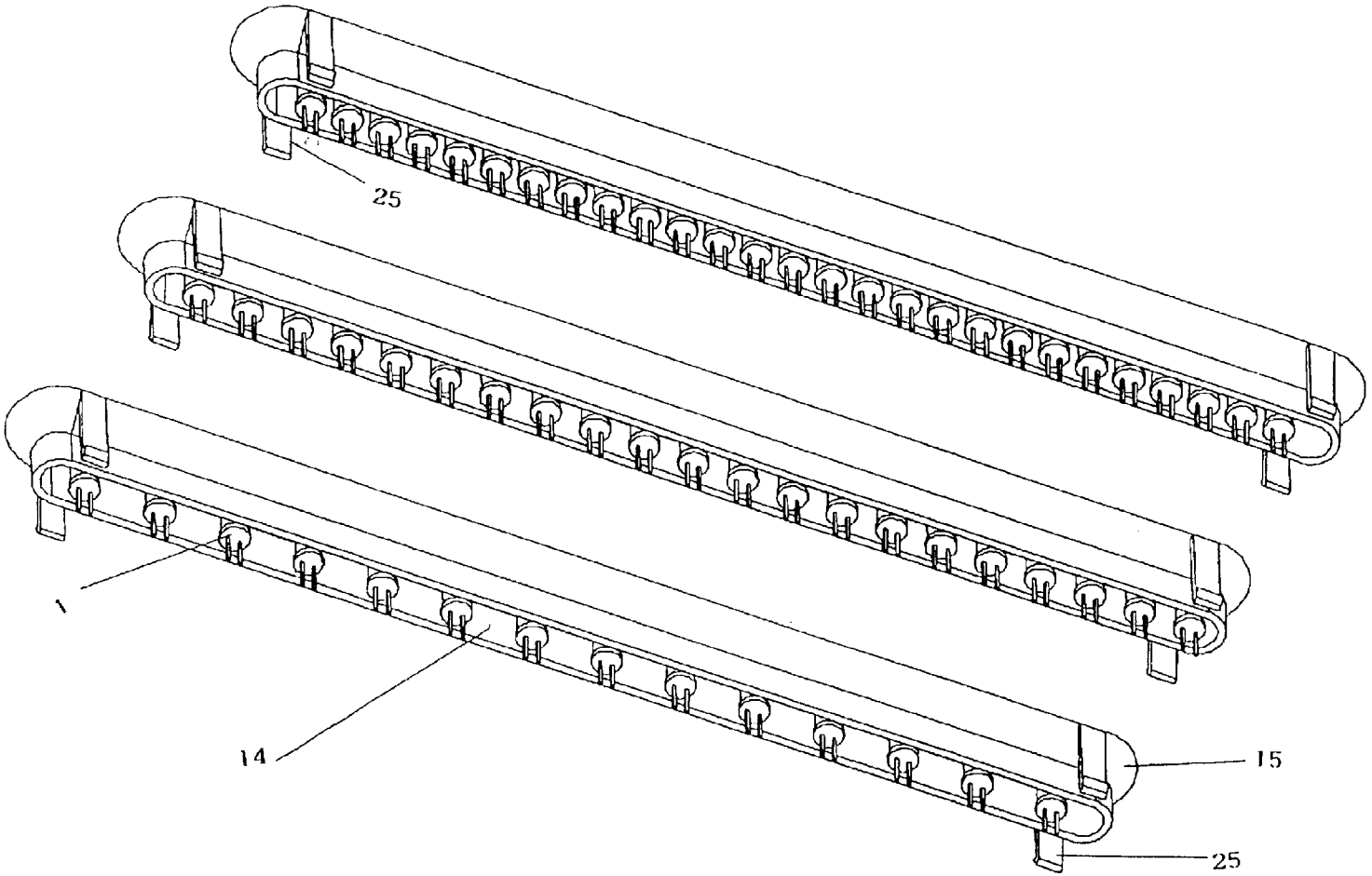
FIG. 7 is an isometric schematic view showing alternate LED distributions within a LPC.
Figure 9A:
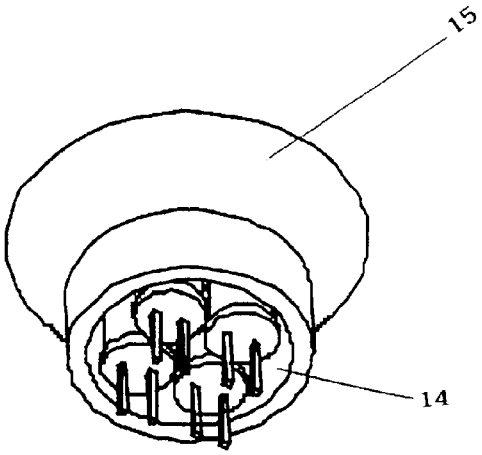
FIG. 9*a* is an isometric schematic view from below of a LPC for a cluster of 4 LEDs.
Figure 9B:
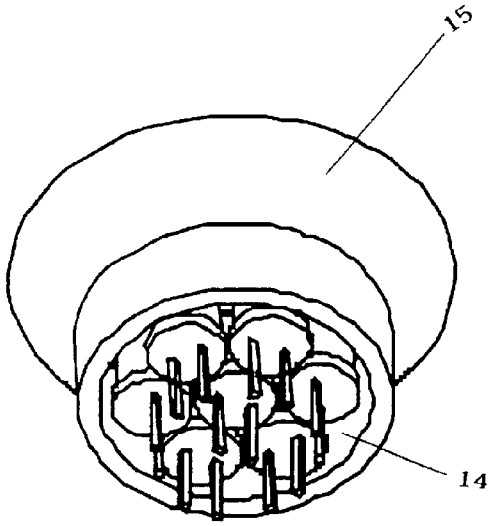
FIG. 9*b* is an alternate embodiment of the LPC of FIG. 9*a* for 7 LEDs.

As new generations of LEDs having greater light output per unit become available, the number of LEDs 1 required to maintain the same light output will decrease. An LPC 15 for multiple LEDs can be used without modification with each new generation of LEDs or across different LED signal models, requiring different light output levels, by modifying the number and distribution of the LEDs within the receiving chamber 14, as shown in FIG. 7. In another embodiment, as shown in FIGS. 9*a* and 9*b*, the LPC 15 is designed to surround a cluster of LEDs 1. Here the distribution of the LEDs within the receiving chamber 14 can also be modified as LEDs improve or as the light intensity level of the specific application demands.

Figure 4:
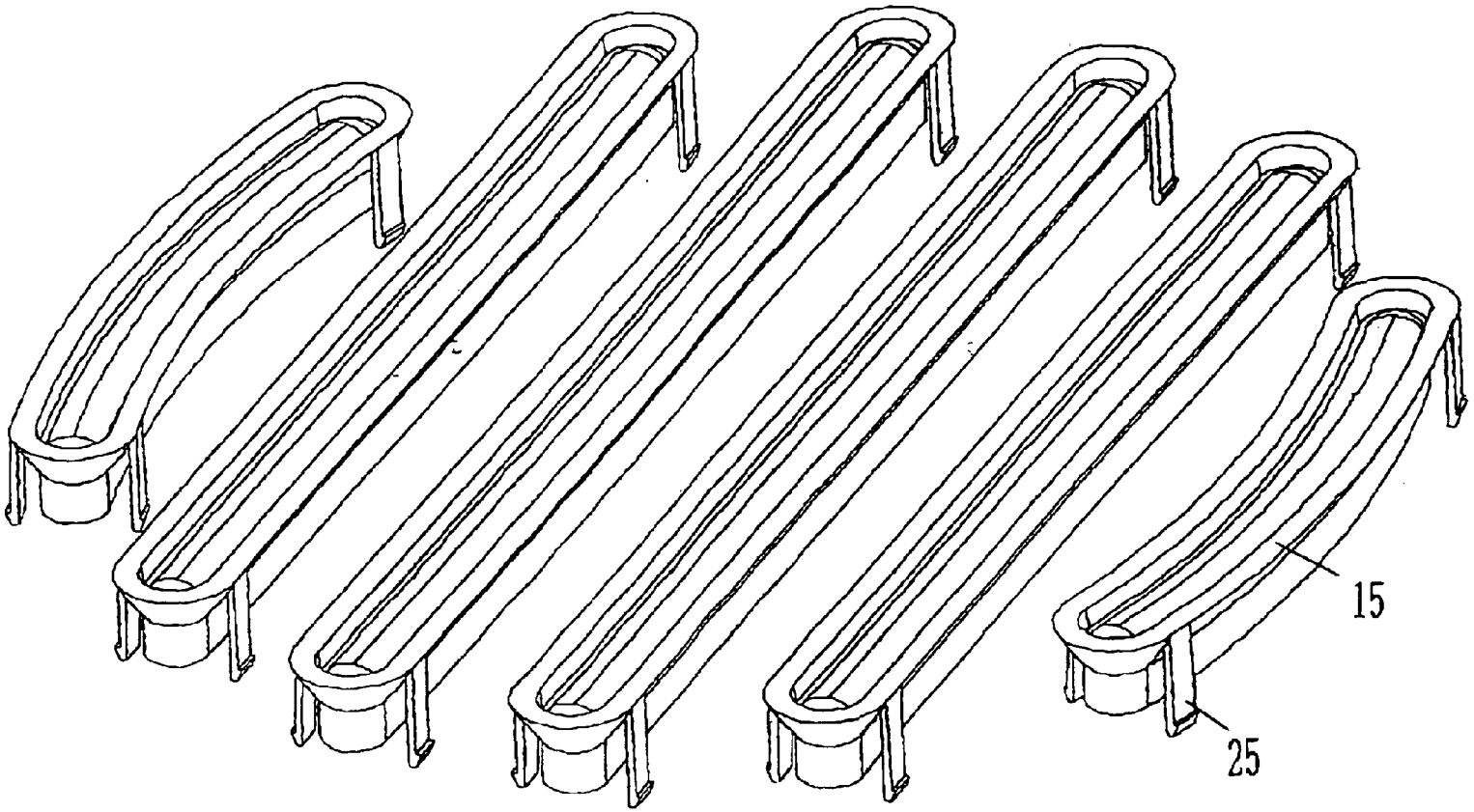
FIG. 4 is an isometric schematic view of a set of linear and curved LPCs.
Figure 5:
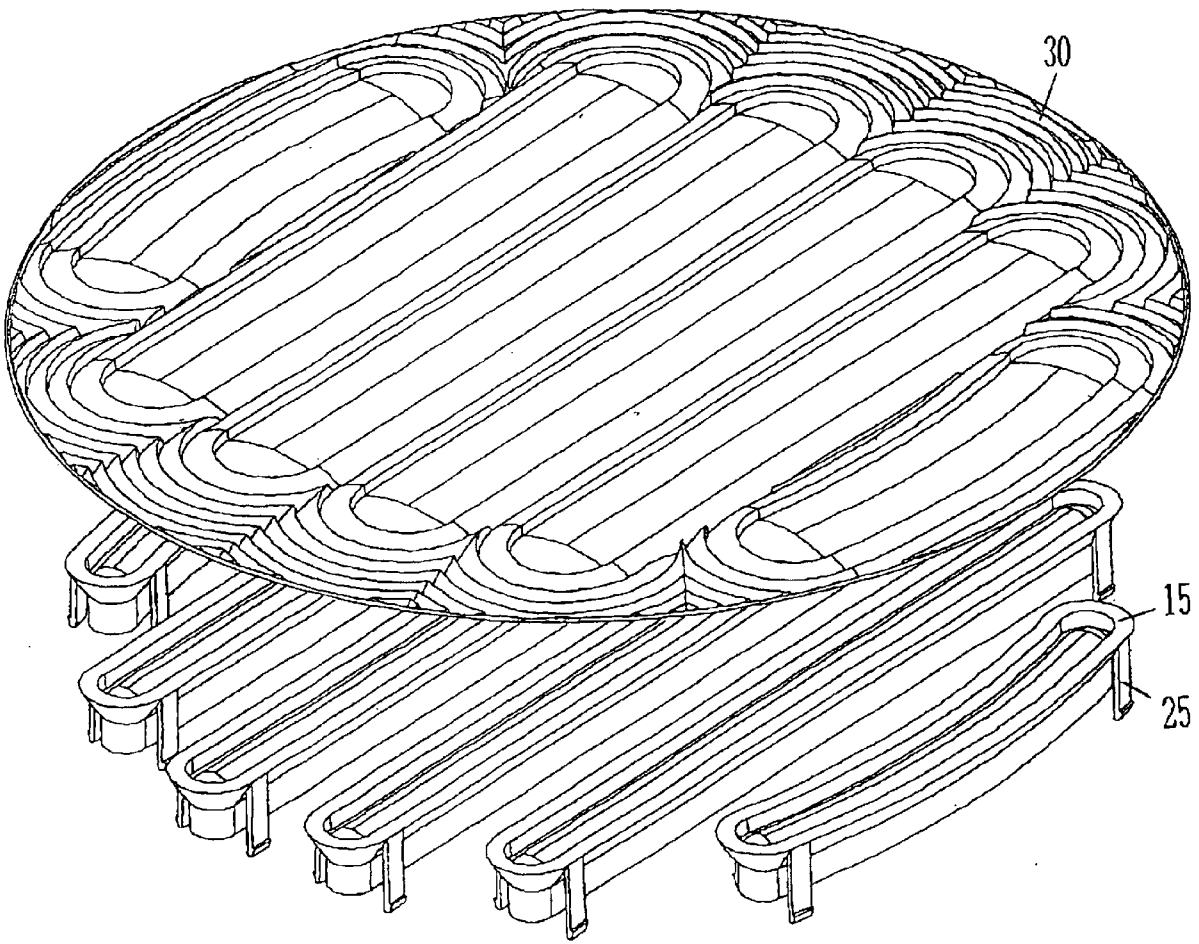
FIG. 5 shows the LPCs of FIG. 4 in matching orientation with an MCZE.

The LPC 15 is distributed across the PCB, following the LED 1 placement. The LPCs can be configured to follow multiple LEDs in a linear or arched configuration, as shown in FIG. 4, the overall layout matching other optical elements, for example as shown in FIG. 5.

Figure 10A:
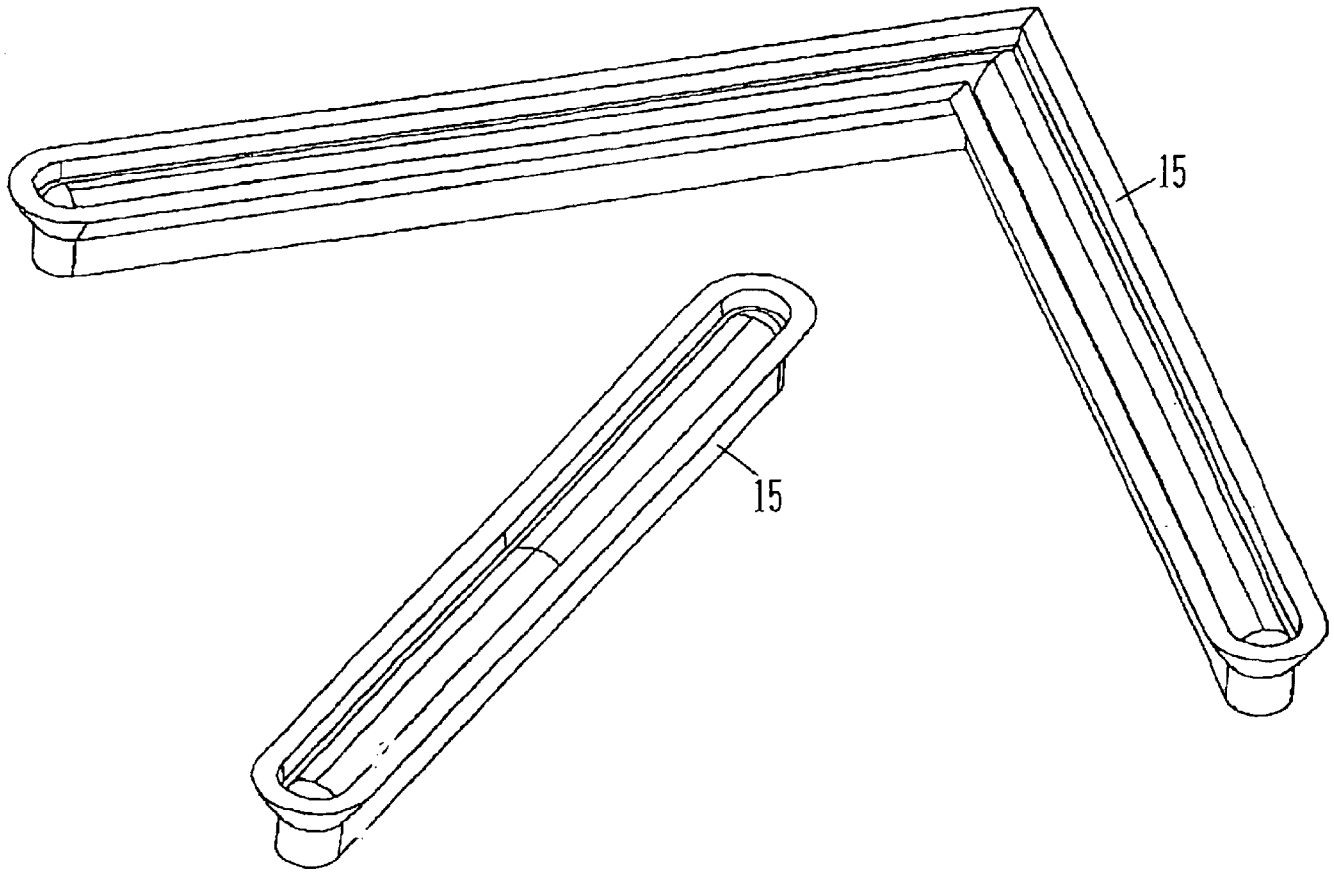
FIG. 10*a* is an isometric schematic view, from above, of a LPC configured as a directional signal.
Figure 10B:
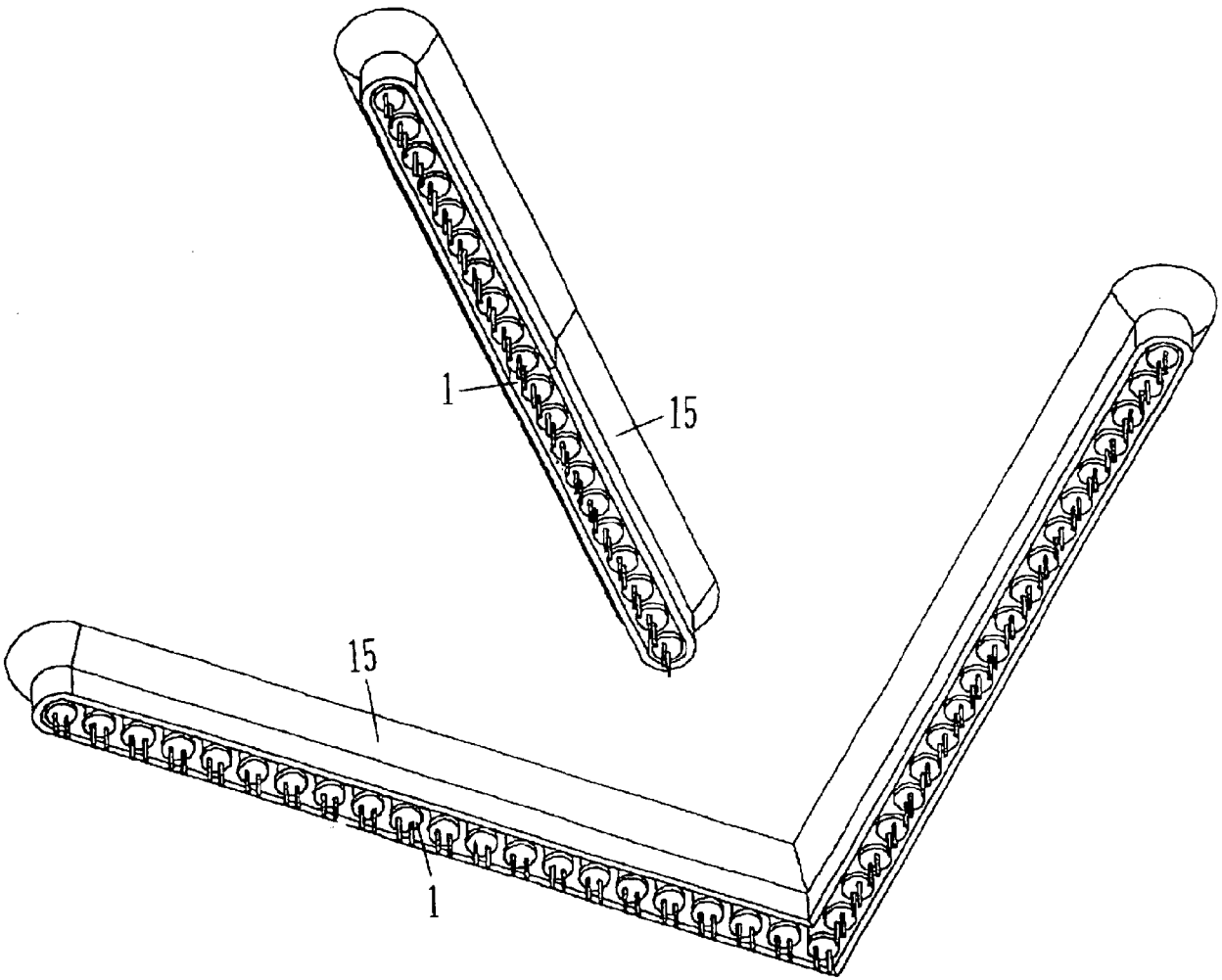
FIG. 10*b* is an isometric schematic view of the LPC of FIG. 10*a*, from below, showing the location of the LEDs.

The LPCs may be used to create directional or informational symbols, letters or pictograms, for example as shown in FIGS. 10*a* and 10*b*. This embodiment is especially useful when designed as a complete optical system with only an outer mask/cover.

LPCs of all types may be connected to the PCB via connection means such as bayonet-type pass-through snap connectors 25. This type of connection is quick to assemble and requires no additional fasteners or special tools.

Figure 11:
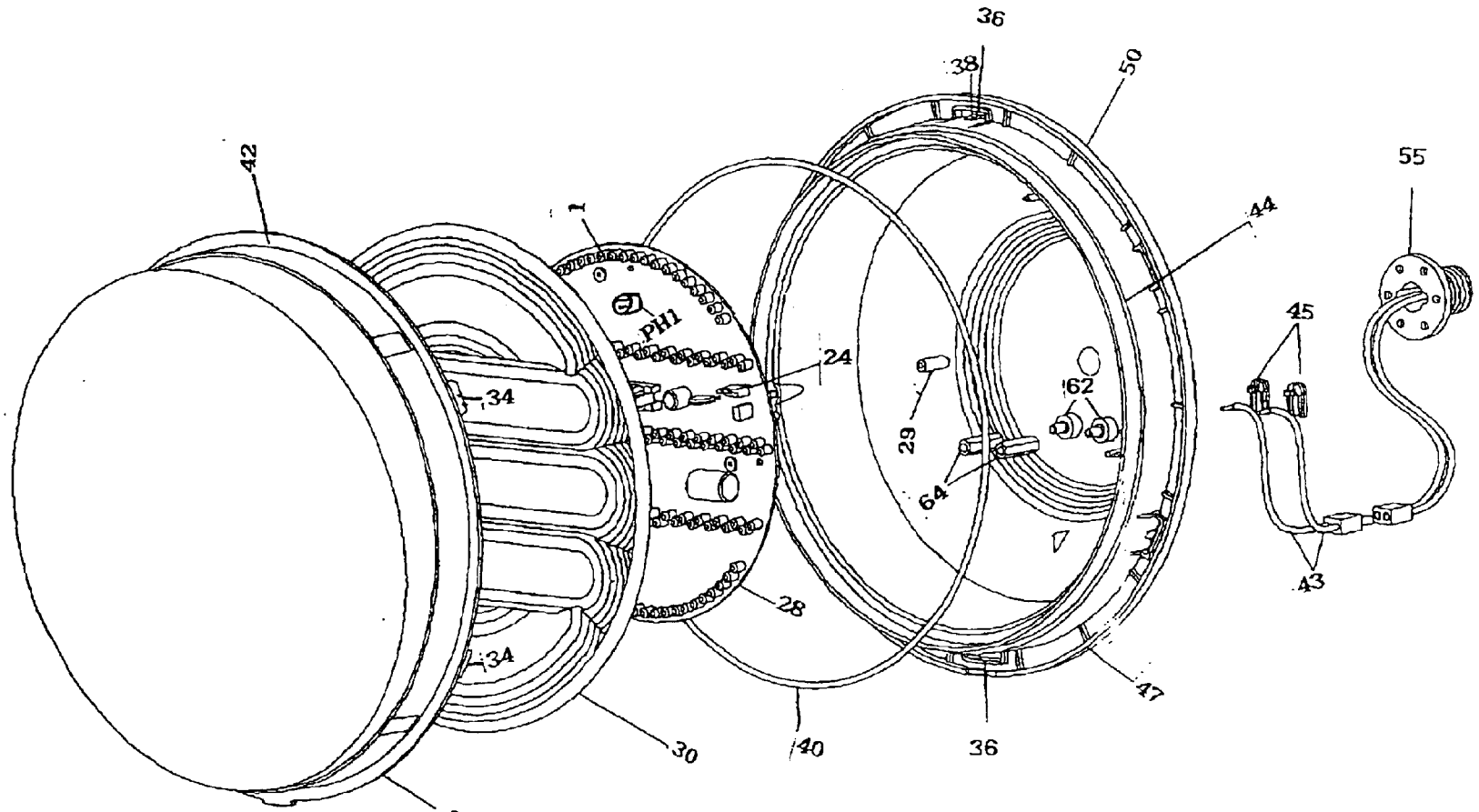
FIG. 11 is an exploded view showing the various components of an LED signal.

Referring to FIG. 11, the main components of a 12" traffic signal embodiment of the invention are visible. A housing 50 holds the components of the traffic signal. The housing 50 may be formed from, for example, polycarbonite material. Polycarbonite material having excellent strength and impact resistance characteristics. Formed into the base of the housing 50 are metal power terminals 62. The metal power terminals 62 have exposed threaded posts on the internal side upon which a power connector spacer 64 may be attached. The PCB 28 is attached to the power connector spacer 64 with screws. The PCB 28 has mounted upon it a pattern of LEDs 1. In this embodiment the LEDs 1 are arranged in horizontal rows and arcs. Between the rows are arranged the power supply components 24. The power supply components 24 are arranged in a way that minimizes the interference with the light emitted from the LEDs 1. The PCB 28 fits into the housing 50 via mounting posts 29 and is fixed in place with screws. To allow as large a PCB 28 as possible, thereby allowing a larger distribution of LEDs 1, the PCB 28 is angled within the housing 50. The mounting posts 29 orient the PCB 28, precisely aligning the LEDs 1 of the PCB 28 with respect to the MCZE 30 into parallel planes. The MCZE 30 is oriented with respect to the housing 50 by placement upon the top surface of the housing 50 upon which it is retained by mounting posts on the housing 50 and distribution cover 32.

Figure 14:
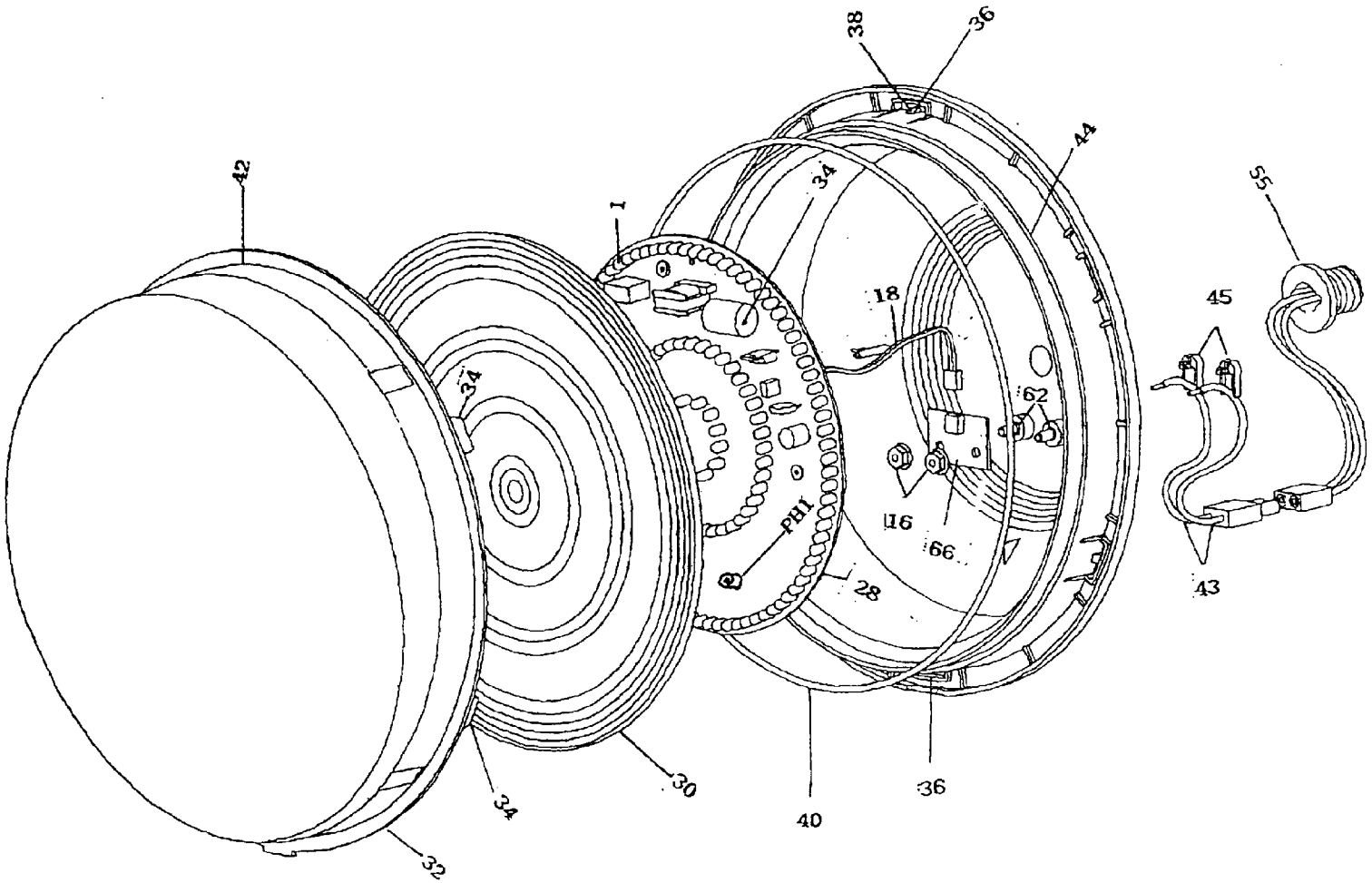
FIG. 14 is an exploded view showing the major components of a circular MCZE embodiment of the invention.

The MCZE 30 may also be formed in, for example, a circular, or horizontal/vertical linear configuration. An embodiment with a circular MCZE 30 is shown in FIG. 14. Here, the PCB 28 is alternatively powered via a power connector cable 18 which connects to a power connector board 66 mounted on the metal power terminals 62 using nuts 16.

Figure 15:
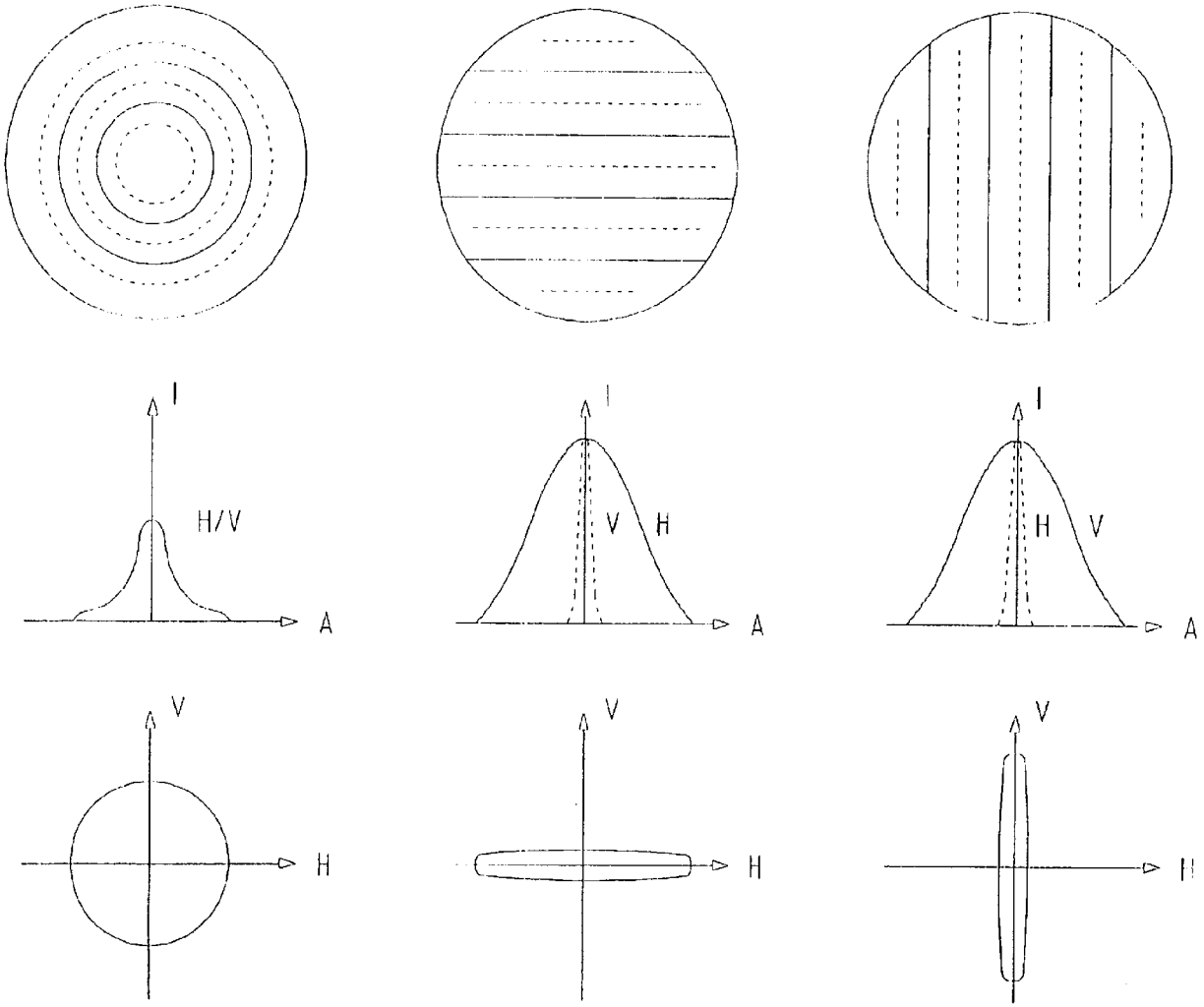
FIG. 15 is a diagram showing possible light distribution and intensity for circular, horizontal and vertical embodiments of the MCZE.

As shown in FIG. 15, the different MCZE configurations (circular, vertical and horizontal) result in different light distribution patterns with corresponding spatial intensities of the collimated light exiting the MCZE. Use of fringe optical corrections and combinations of linear with circular and/or arcs creates a light distribution tailored to a specific application.

Depending on the application, a different MCZE configuration and matching PCB layout may be selected. For example, a railroad application may use a vertical linear MCZE as the required horizontal viewing aspect is very narrow (generally the train track width), while the wide vertical aspect allows viewing of the signal from a wide vertical range, corresponding to viewing locations near and far from the signal at either track or train cab level. Similarly, an automobile traffic signal may be designed with a majority of horizontal linear zones in the MCZE to have a wide spread horizontally, across many lanes of traffic. Final tuning of the light distribution is made by the distribution cover 32. Ray tracing computer software allows calculation of very specific optical solutions for the MCZE 30, LPC 15 and distribution cover 32. Where the LPC, alone, creates an acceptable light distribution and or uniform display aspect, the MCZE 30 may be omitted.

Materials reduction cost savings and increased assembly efficiencies are realized by the snap together housing 50 and distribution cover 32.

Figure 16:
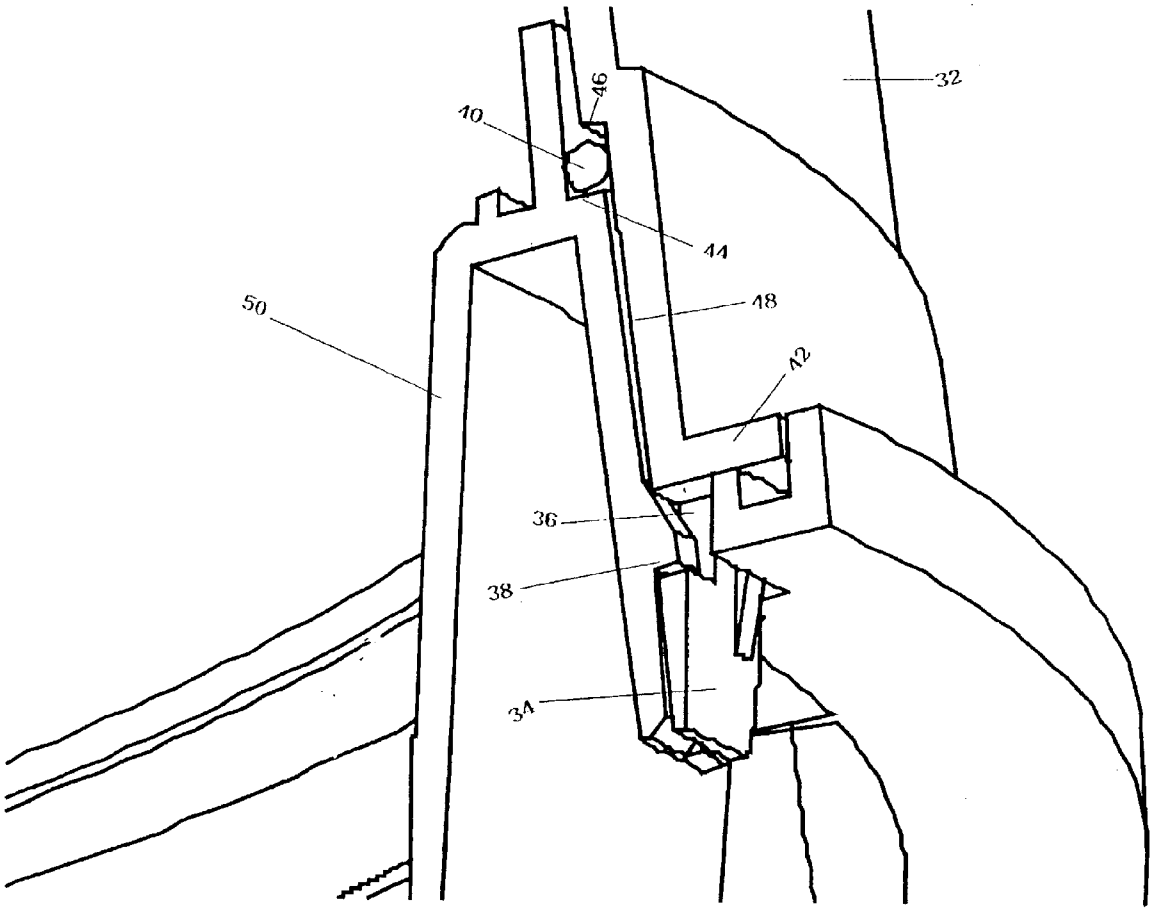
FIG. 16 is a close-up view of the o-ring sealing means and connection tab into tab socket connection means.

As shown in FIG. 11, the distribution cover 32 snap fits into the housing 50. A detailed, close-up view of the connection and sealing means, discussed below, is shown in FIG. 16. Connection tabs 34, arranged around the periphery of distribution cover 32, fit into tab sockets 36. Tab socket keys 38 located proximate the tab sockets 36 lock the connection tabs 34 in place upon insertion, The mating point between the tab socket key 38 and a corresponding hole 35 in the connection tab 34 is arranged and configured to retain the distribution cover 32 at the location where the DC foot 42 bottoms against the housing 50. One connection tab 34 and corresponding tab socket 36 are slightly wider than the others, thereby allowing assembly of the distribution cover 32 and housing 10 in only a single, proper, orientation.

A dust and water resistant seal is provided by o-ring 40. The o-ring 40, preferably made of EPDM material, is sized to elastically fit upon housing shoulder 44. Distribution cover 32 has a primary radius 48 which allows the distribution cover 32 and housing 10 to be initially loosely fitted together, aligned by the connection tabs 34 fitting into tab sockets 36. A final snap fit bottoms DC foot 42 against the housing 50, engages the tab socket keys 38 to the corresponding holes 35 in connection tabs 34 and seats o-ring 40 between housing shoulder 44 and cover shoulder 46. In addition to providing the environmental closure seal between the distribution cover 32 and housing 50, the o-ring 40 provides a shock dissipation function for impacts upon the distribution cover during use.

Power may be supplied to the traffic signal via main power wires 43. The main power wires 43, having the ends stripped to expose the bare conductor, fit into holes in the outside surface of the power terminals 62. The fit of the main power wires 43 into the power terminals 62 is loose. Electrical contact between the main power wires 43 and power terminals 62 is insured by the use of main power connector covers 45. With the main power wires 43 inserted into the power terminals 62 the main power connector covers 45 are friction fit into the holes thereby retaining the main power wires 43 in electrical contact with power terminals 62. The main power connector covers 45 have a cover extending along the main power wires 43 in the down direction, thereby shedding any moisture which may collect or be moving across the back of the housing 50. The main power wires, as shown in FIG. 11, may connect to a standard incandescent lamp socket using an incandescent lamp socket plug 55.

Figure 17:
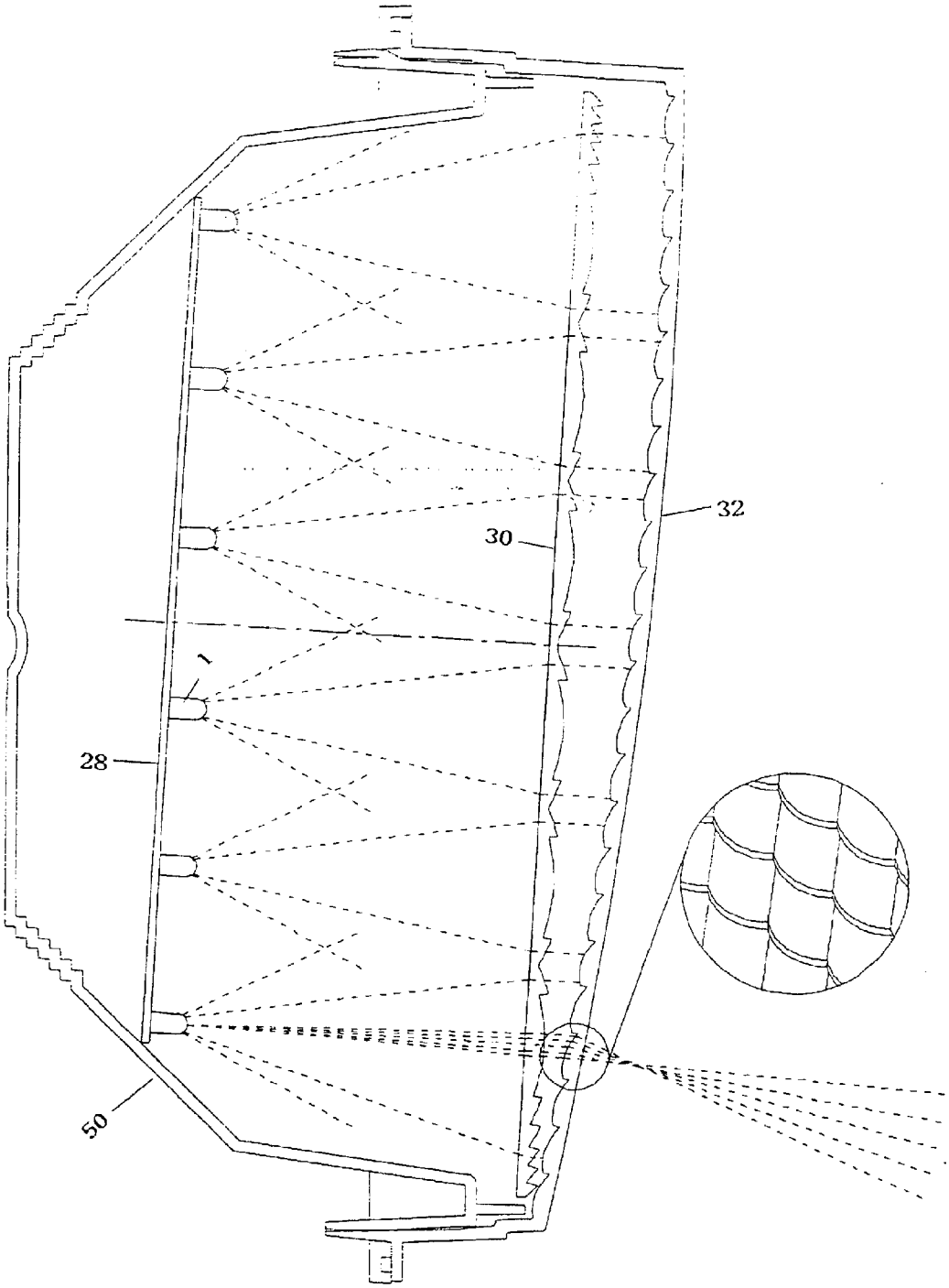
FIG. 17 is a cut-away side view of the 12" embodiment of the invention (electrical and interior components omitted for clarity), showing a ray diagram between the LEDs and the distribution cover and an example of the distribution cover's optical effect.
Figure 21:
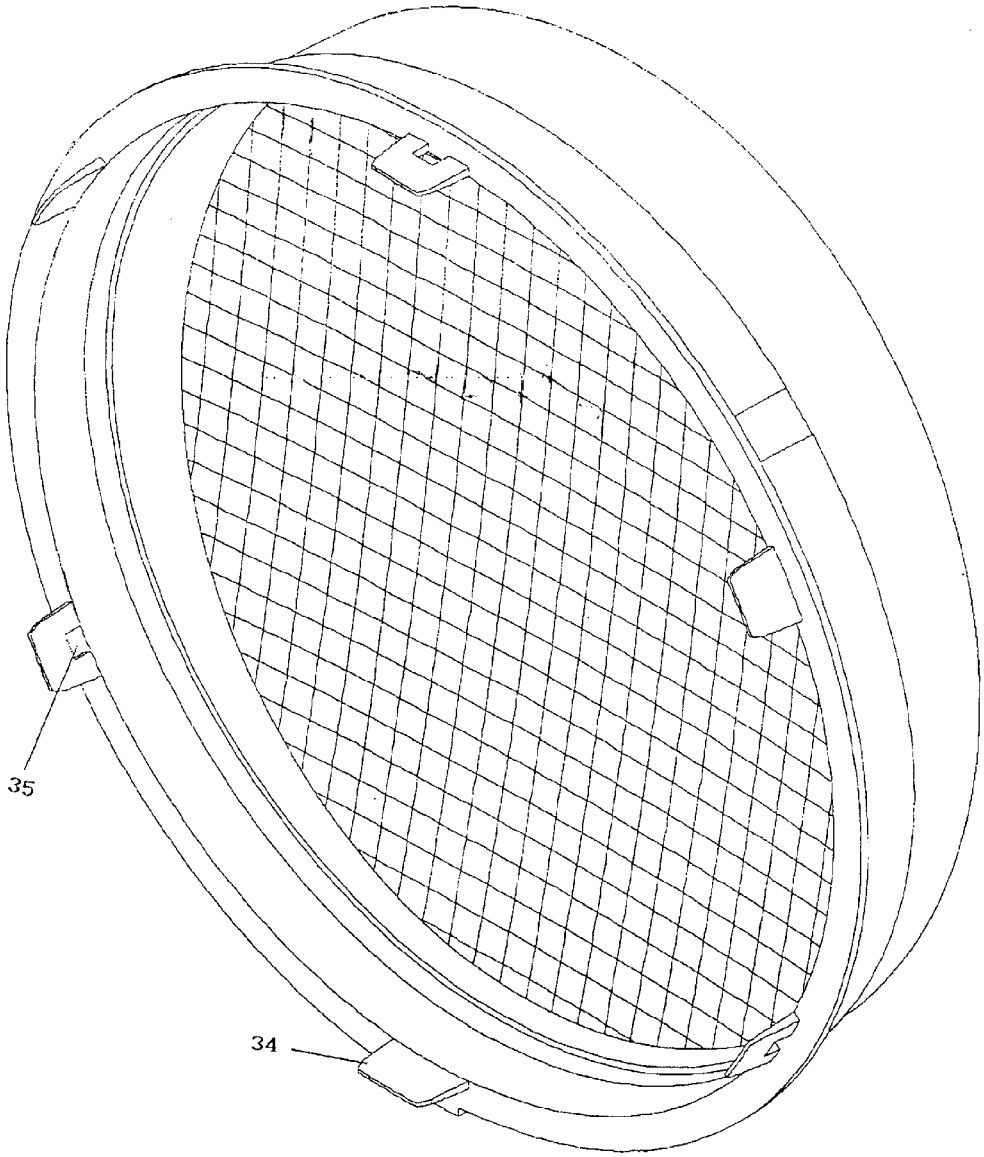
FIG. 21 is a three dimensional view of the backside of the distribution cover, detailing the compound optical correction surfaces.
Figure 22:
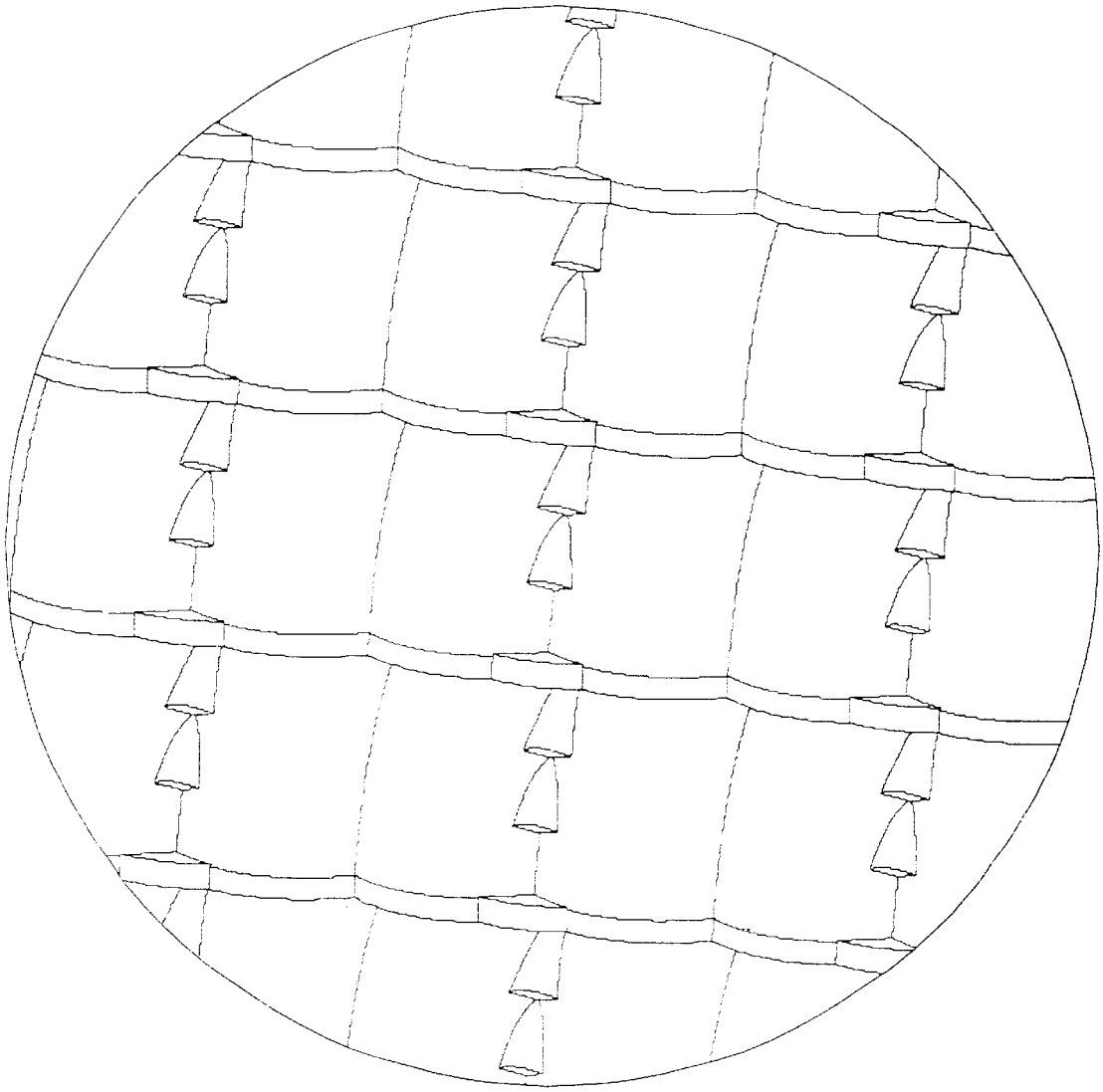
FIG. 22 is a close-up three-dimensional view of a portion of the optical correction surfaces shown in FIG. 21.

As shown by FIG. 17, the calculation of the pattern of the MCZE 30, preferably made of acrylic material, with respect to the PCB 28 and the location of the LEDs 1 thereon is very precise. Taking into account the constraints of the size of the housing 50, allowing it to fit within existing signal openings, the distance between the PCB 28 and the MCZE 30 is made as large as possible. Then, taking into account the angle of usable light emitted from the LEDs 1 and LPC 15 if present, a pattern of LEDs in concentric circles, arcs and/or linear rows is formed on the PCB 28 to cover the surface of the MCZE 30 fully with LED light. The MCZE 30 has multiple circular or linear collimating zones arranged matching the concentric circles or linear rows of LEDs 1 on the PCB 28. Each circular or linear collimating zone collimates the light emanating from its respective LED 1 and/or LPC 15 arc, ring or linear rows. As shown in FIG. 17, the LED light patterns slightly overlap within and between the rings or rows thus preventing the appearance of shadows, lines, or rings. Due to the overlap, individual LED 1 failure, or variation in LED 1 output between adjacent LEDs 1 will be minimally discernable by the viewer, if at all. At the outer edge of the MCZE 30, fringe elements collect spurious light from within the housing and collimate it in a forward direction. The end result of the combination of the PCB 28 having LEDs 1 and/or LPC 15 and matching patterned collimating elements of the MCZE 30 is to produce a full pattern of collimated light emitted from the MCZE 30 without gaps discernable to the viewer. The collimated light from the MCZE 30 passes next to the distribution cover 32. Where LPCs 15 are used without an MCZE 30, the light emitted by the LPC 15 passes directly to the distribution cover 32. The distribution cover 32 has a further pattern on its inside surface, shown in FIGS. 21 and 22 which directs the collimated light into a final distribution pattern optimized for viewing at the normal design distance and angle from the front of the signal.

Figure 18:
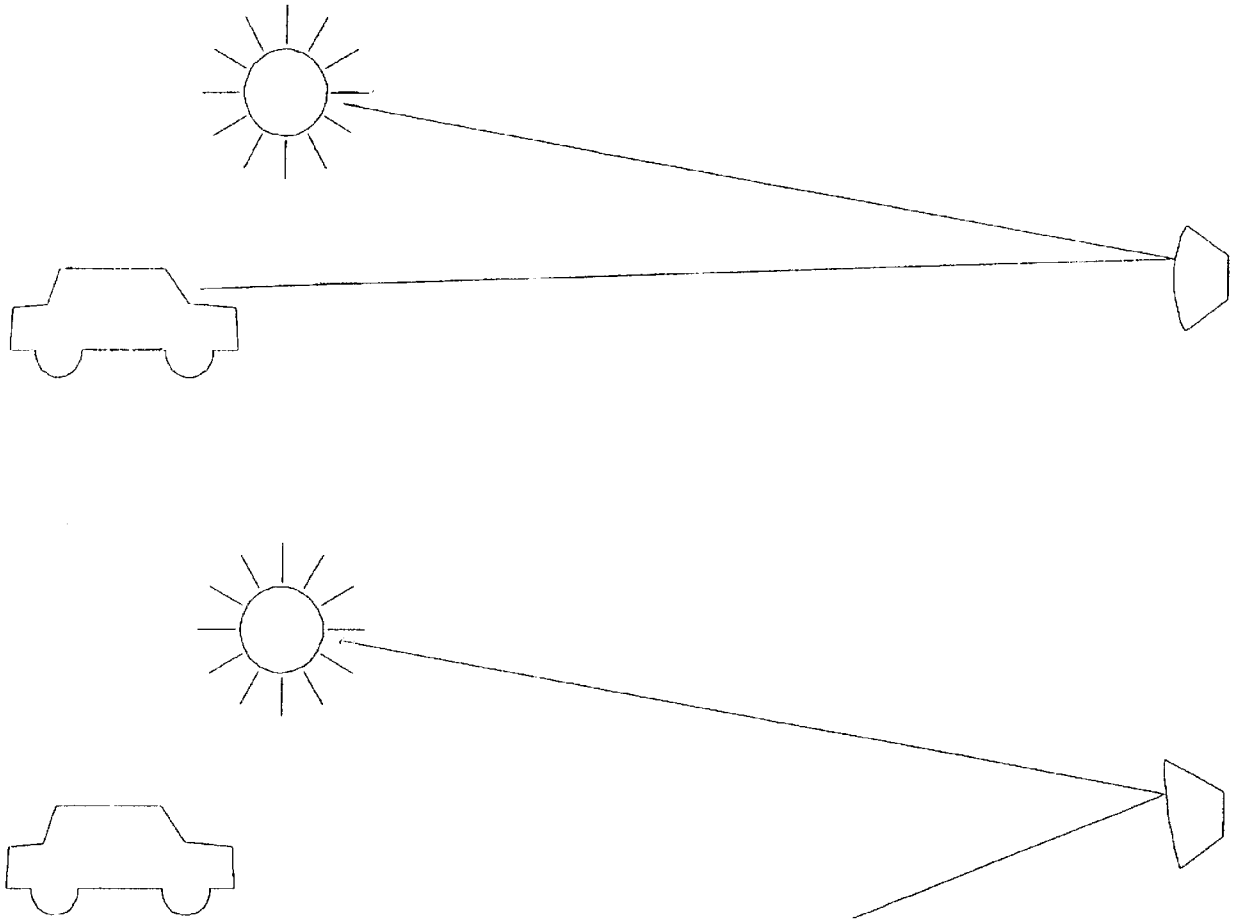
FIG. 18 is a diagram demonstrating the "sun phantom" effect.

The present invention uses a large radius (more than 24" radius for the 12" embodiment and more than 18" radius for the 8" embodiment) outer surface of the distribution cover 32. The large radius simplifies the optical solution for the pattern on the back of the distribution cover. The outer surface of the distribution cover 32 is aligned at an angle inclined towards the ground. As shown by FIG. 18, this has the effect as compared to a conventional forward facing small radius spherical lens traffic signal of reflecting any sun light or other light source towards the ground rather than back towards the viewing position intended for the signal. A problem of LED signals in the past has been external light sources reflecting into the signal encountering the LEDs which have a highly reflective back surface, creating a noticeable "sun phantom" effect. In the present invention the increased distance between the LEDs 1 and the outer surface of the distribution cover 32 minimizes the chance for internal reflection resulting in a "sun phantom" effect. Further, the back face of distribution cover 32 is designed to again direct any external light source to the ground rather than back to the intended viewing position of the traffic signal.

Figure 19:
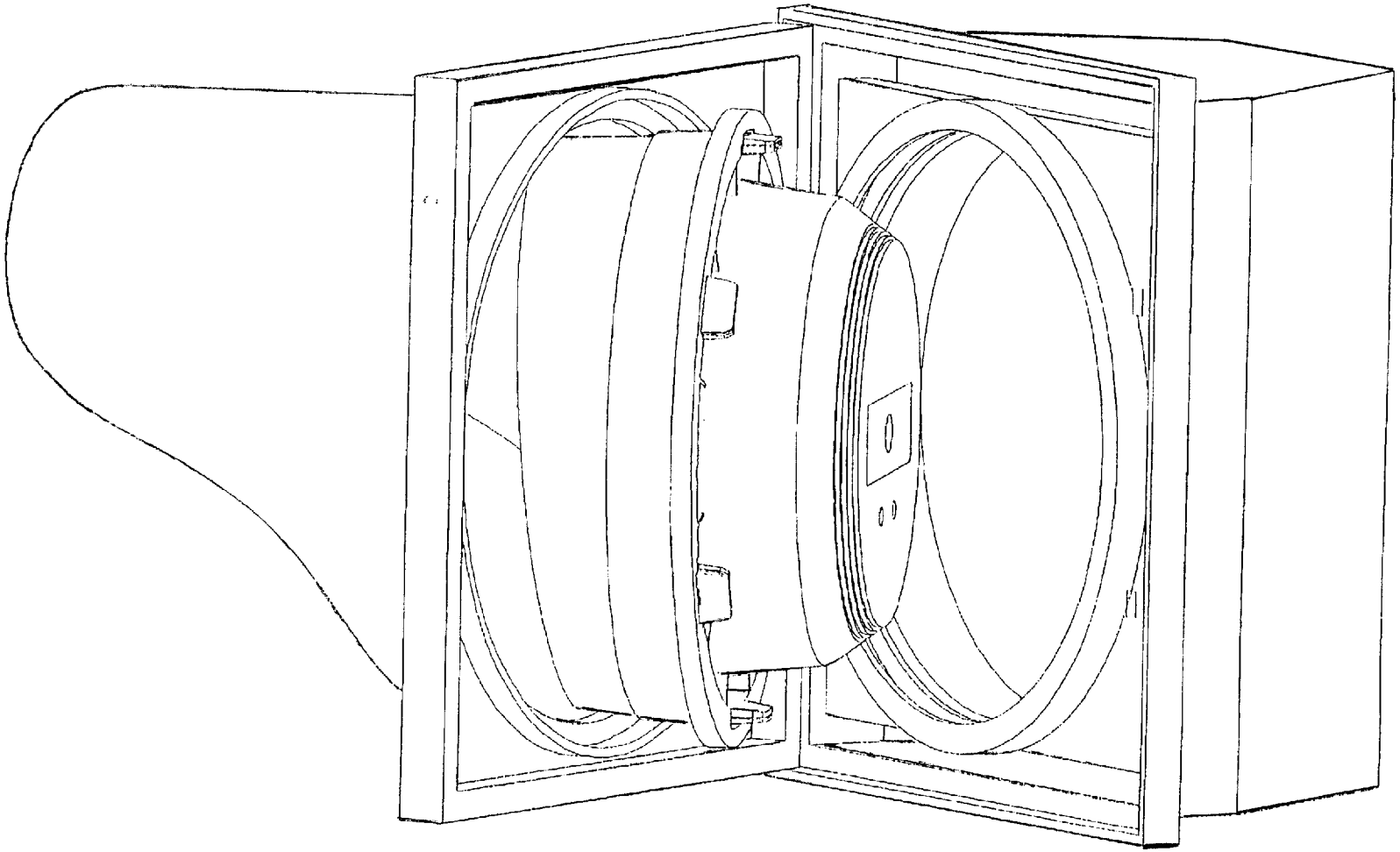
FIG. 19 is a view of a typical traffic signal housing, showing retrofitting of the present invention, replacing the original outer lens and incandescent lamp.

As shown in FIG. 19, the present invention may be easily retrofitted into an existing traffic signal upon removal of the original outer lens and incandescent lamp. The housing outer rim 47 may be designed to have the same thickness as the lens it replaces. Power connection of the retrofitted light may be performed, without requiring an electrician, by simply screwing the incandescent lamp socket plug 55 into the original incandescent lamp socket.

Figure 20:
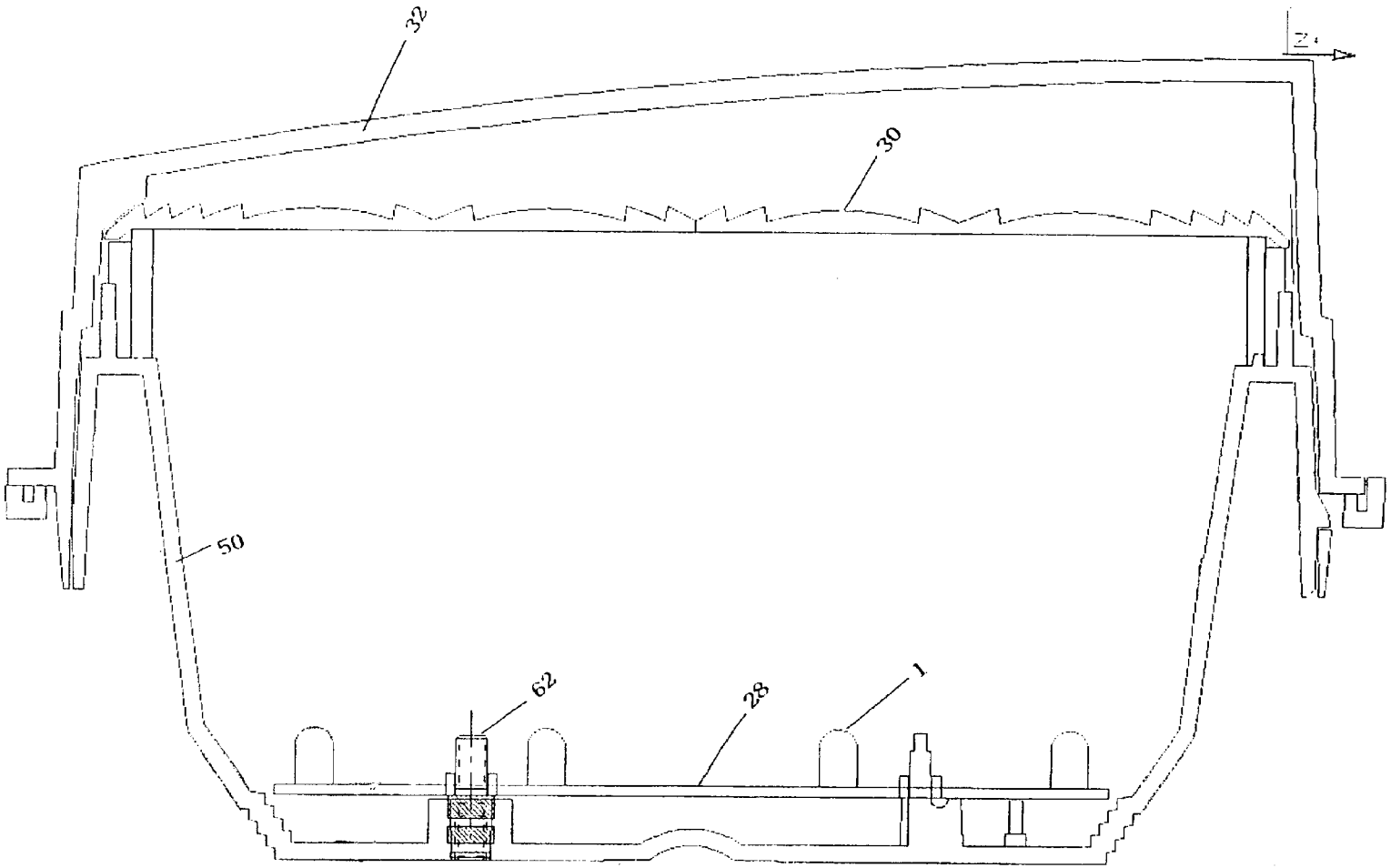
FIG. 20 shows a cut-away view of an 8" embodiment of the invention (power supply components omitted for clarity).

In another embodiment, shown in FIG. 20, the invention is adapted to fit in an existing 8" incandescent traffic signal upon removal only of the incandescent bulb and outer lenses. As space permits, the PCB 28 is not angled and therefore direct connection to power terminals 62 can be made without use of a separate power connector board 66 and power connector cable 18 or power connector spacer 64. The MCZE 30 and inner surface of the distribution cover 32 are optimized for the different LED 26 layouts and angles of the PCB 28 and MCZE 30 with respect to the distribution cover 32.

The above invention is optimized for presently available cost effective LEDs 1. As higher output, cost effective LEDs become available, fewer LEDs 1 will be required to obtain the same light output. Due to the overlapping output of the present LEDs, when higher output LEDs become available, modification of only the LED spacing on the PCB is required. LPCs, if present, may be designed to allow the LED spacing within the receiving chamber 14 to be varied without requiring redesign of the LPC.

If output of the LEDs increases beyond the point where placement of fewer LEDs in the concentric rings or linear rows still results in overlap, then only the MCZE need be recalculated. When the MCZE is used, the distribution cover is independent of the light source as it receives an even distribution of collimated light from the MCZE for final distribution to the viewer.

Referring now to FIG. 11, a light sensor PH1 is mounted on the PCB 28. The light sensor PH1 may be, for example, a photo diode, a photo transistor, a photo cell or other device capable of outputting a signal with respect to the light level sensed. Light sensor PH1 is an input for a comparator circuit which compares the input to a reference voltage. If the input does not exceed the preset level, a short circuit is created between the AC power and AC neutral input lines which burns out a fusible link placed at the power input to the PCB 28, deactivating the signal. Where the light sensor PH1 is a photo transistor, a common voltage comparator circuit may be used. The reference voltage, set by selection of the resistor in the voltage comparator circuit, determines the light level at which the fusible link will be burnt out. The short circuit may be created by, for example, a mosfet switch.

Figure 12:
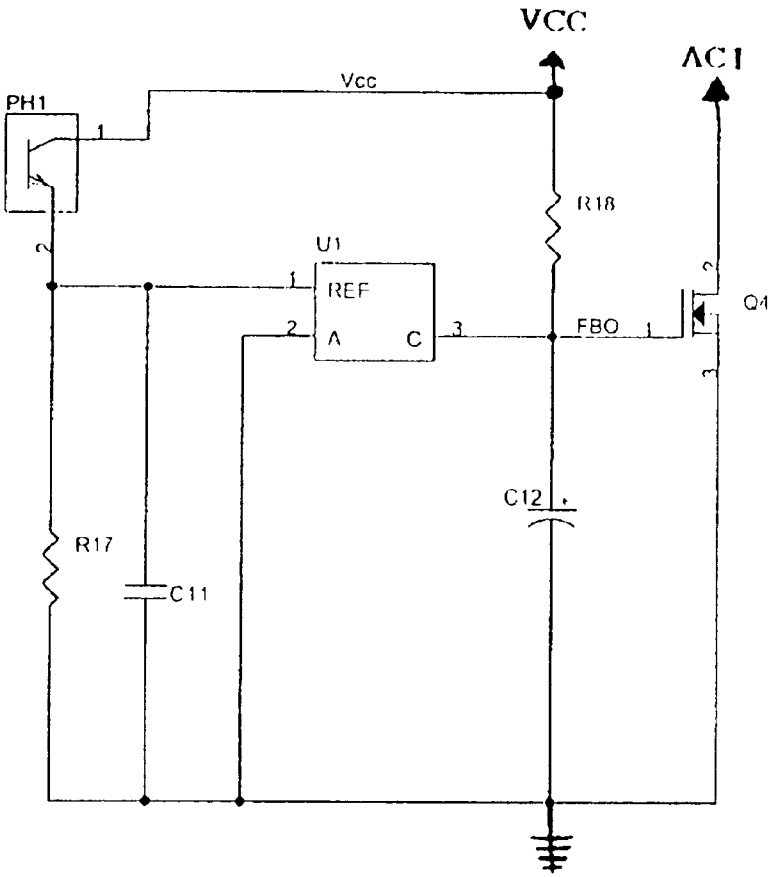
FIG. 12 is an electrical schematic showing the automatic light degradation sensor control circuit.
Figure 13:
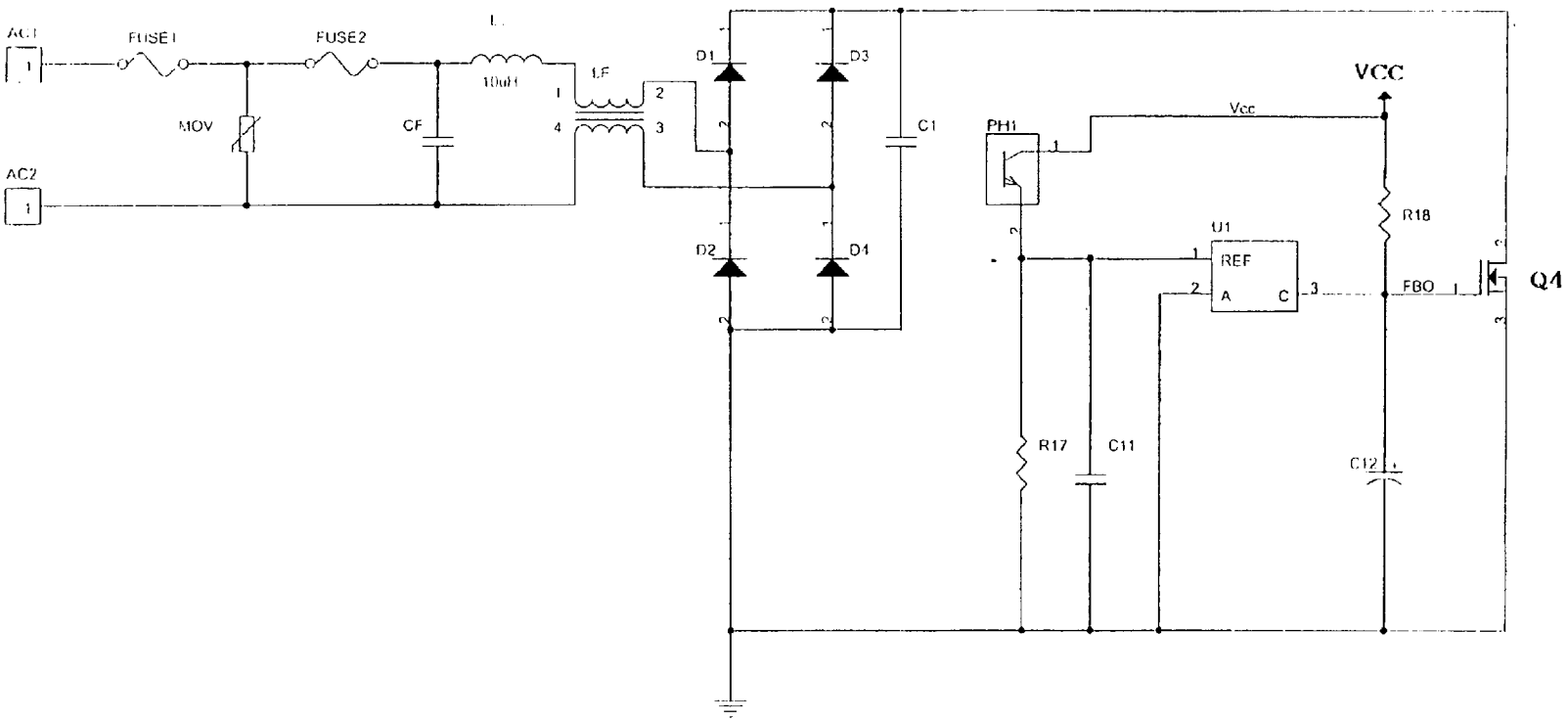
FIG. 13 is an electrical schematic showing the automatic light degradation sensor circuit including the LED signal, AC power connections and a fusible link for disabling the LED signal.

A specific example of the electrical circuitry is shown in FIGS. 12 and 13. The switching portion of the light degradation sensor circuit is shown in FIG. 12. Light sensed by a photo transistor PH1 creates a proportional current output which, transformed by resistor R17 and filtered by capacitor C11 is seen as a voltage level input to the REF pin of comparator integrated circuit U1, for example a TL431 adjustable precision shunt regulator. The selected value of resistor R17 sets the voltage level proportional to the desired light level which the comparator circuit U1 will compare to its internal reference voltage. As the LED light output degrades over time, PH1 senses less and less light, lowering its output. When the voltage at the U1 Ref Pin falls below the U1 internal voltage, U1 opens the short circuit between pins A and C causing the FB0 to go high, closing Q4. In normal operation, LED light in the housing will be sensed by PH1 creating an output high enough so that the voltage at the U1 Ref pin is higher than the U1 internal reference voltage. As long as the U1 Ref Pin is at a higher voltage than the U1 internal reference voltage, U1 pins A and C will be shorted causing the FB0 signal to be grounded, which in turn maintains Q4 in a blocked state. An RC network comprising resistor R18 and capacitor C12 provides a transient suppression effect to prevent a false energized state in FBO from momentarily occurring and falsely causing a disabling short circuit.

FIG. 13 shows the interaction of the switching portion of the light degradation sensor circuit, shown in FIG. 12, with the power input to the LED signal. When power mosfet Q4 is closed, a short circuit is created between ground and AC 1. Fuse 2 has an approximate rating of 250 mA. High current levels created by the short circuit quickly blows Fuse 2. Fuse 1, having a rating of approximately 4–5 amps is used for protecting against problems in the power supply lines AC1 and AC2. If a voltage spike occurs in the supply lines a metal oxide varistor MOV shorts the lines, protecting the LED signals electronics. Placement of the metal oxide varistor between Fuse 1 and Fuse 2 prevents line transients from falsely blowing the low current rated Fuse 2. Fuse 2 is directly soldered onto the PCB 28, preventing easy replacement or bypassing of the fuse after it has been blown. This feature frustrates "repair" and continued use of the LED signal after the LED light output has degraded below the design level.

To ensure that the light sensor PH1 is reading the aggregate light output level of the LED signal and not just the output of the closest LED(s) 1 a baffle, shroud or blinder 27 as shown in FIGS. 24–27 may be used so that the light sensed is a reflection off of the optical elements and/or the housing side walls and not dependent just on the output of the closest LED(s) 1.

The light sensor is in operation whenever the LED signal is energized. During daylight use, external light levels may influence the light sensor PH1 into a false reading that LED 1 output levels are normal even though they have in actuality degraded below the acceptable level. This is not a problem as the degradation in output levels occurs over a period of years. As the cut-off level approaches, a difference of an additional 12 hours (for nighttime or other transient interruption of the external light to occur) is immaterial. This also prevents a temporary output degradation due to extreme heat from triggering a fuse blow out. A capacitor, resistor combination or other timed delay can be used to create a known delay period during which the input must be below the reference level or the circuit will reset and be forced to pass through the entire delay period again before triggering the fuse blowing short circuit. This feature prevents line voltage transients that may temporarily lower light output or create a false output at the mosfet Q4 from triggering the fuse blowout.

A family of signal devices may be created from the present invention using common components. Different distribution covers, creating different distribution patterns may be snap fitted onto a common housing with standardized PCB and MCZE. Information and/or directional signals may be created by masking portions of the distribution cover into, for example, turn signal arrows.

A variation of the housing, using otherwise similar components may be used to create efficient stand alone signals or even general illumination light sources useful, for example, when it is foreseen that the light source will be located where maintenance will be difficult and an extreme service interval is desired.

Further, although particular components and materials are specifically identified herein, one skilled in the art may readily substitute components and/or materials of similar function without departing from the invention as defined in the appended claims.

The present invention is entitled to a range of equivalents, and is to be limited only by the following claims.

We claim:

1. An LED signal comprising:

a housing having an interior area and an open end, at least one LED, a light sensing means;

a comparator means;

said at least one LED arranged and configured within said interior area of said housing;

said light sensing means located within said interior area of said housing, having an output value relative to a light level within said housing;

said comparator means comparing said output value to a reference value;

if said output value is below said reference value said comparator initiates a disablement means.

2. The LED signal of claim 1, wherein:

said light sensing means is a phototransistor.

3. The LED signal of claim 1, wherein:

said comparator means is a voltage comparator circuit.

4. The LED signal of claim 1, wherein:

said disablement means is a transistor switch that creates a short circuit between a power supply line and a neutral or ground line which increases current through a power supply line fuse to a level where said fuse burns out.

5. The LED signal of claim 1, wherein:

said at least one LED are arranged and configured on a PCB further including LED power supply electrical components and circuitry.

6. The LED signal of claim 1, further comprising:

a cover having a light transmission surface, said cover attached to said housing open end by a means for attachment.

7. The LED signal of claim 6, wherein:

said means for attachment is integral to said distribution cover and said housing.

8. The LED signal of claim 6, wherein:

said light transmission surface is angled with respect to a peripheral mounting surface in contact with said housing.

9. The LED signal of claim 6, wherein:

said signal is a 12" nominal size, and said light transmission surface has a spherical shape having an arc radius greater than 24".

10. The LED signal of claim 6, wherein:

said signal is a 8" nominal size, and said light transmission surface has a spherical section having an arc radius greater than 18".

11. The LED signal of claim 6, wherein:

said means for attachment includes means for aligning said distribution cover on said housing in a desired orientation.

12. The LED signal of claim 6, further comprising:

a sealing means to environmentally seal said LED signal.

13. The LED signal of claim 12, wherein:

said sealing means is an o-ring.

14. The LED signal of claim 6, wherein:

said means for attachment is at least one connection tab on said distribution cover arranged and configured to mate with a corresponding tab socket on said housing.

15. The LED signal of claim 14, wherein:

said tab socket includes a tab socket key arranged and configured to mate with a corresponding cavity in said connection tab.

16. The LED signal of claim 6, wherein:

said housing and said cover are arranged and configured for retro-fitting into a traffic signal having an incandescent light source, optical elements and an incandescent light source reflector, said LED signal sized to fit within a cavity formed by said traffic signal incandescent light source reflector upon removal of said incandescent light source and said optical elements.

17. The LED signal of claim 16, wherein:

electrical power connection is made by connection to an incandescent light source socket.

18. The LED signal of claim 6, wherein:

said at least one LED are arranged and configured to emit light upon a collimating element positioned between said cover and said at least one LED.

19. The LED signal of claim 18, wherein:

said at least one LED emits light in an overlapping light pattern such that failure or diminished light output of a single LED is not discernable to a viewer of said LED signal.

20. The LED signal of claim 18, wherein:

said collimating element includes collimating zones arranged and configured with respect to the distribution of said LEDs on said PCB.

21. The LED signal of claim 20, wherein:

said collimating zones are arranged in concentric circles.

22. The LED signal of claim 20, wherein:

said collimating zones are arranged in horizontal or vertical rows.

23. The LED signal of claim 20, wherein:

said collimating zones are arranged in circles or arcs and horizontal and/or vertical rows.

24. The LED signal of claim 1, wherein:

said housing has external electrical power connectors comprising:

a cavity in an external end of each external electrical power connector, and a connector cover having a compression element;

upon insertion of a conductor into said cavity said connector cover compression element is frictionally inserted into said cavity thereby holding said conductor securely in said cavity in electrical contact with said electrical connector.

25. The LED signal of claim 1, wherein:

said at least one LED is arranged in at least one substantially circular configuration.

26. The LED signal of claim 1, wherein:

said at least one LED is arranged in at least one substantially linear configuration.

27. An LED signal comprising:

a housing having an interior area and an open end;

at least one LED;

a light pipe collector for use with at least one LED comprising:

an optical member composed of light transmissive material, at least one total internal reflection surface, and a receiving chamber for receiving said at least one LED;

said at least one LED emitting light in a main direction and a non-main direction;

said at least one LED arranged and configured within said interior, of said housing;

said total internal reflection surface operating to redirect said non-main direction emitted light to said main direction through total internal reflection.

28. The LED signal of claim 27, wherein:

said at least one LED is arranged and configured on a PCB further including LED power supply electrical components and circuitry.

29. The LED signal of claim 27, further comprising:

a cover having a light transmission surface, said cover attached to said housing open end by a means for attachment.

30. The LED signal of claim 29, wherein:

said means for attachment is integral to said distribution cover and said housing.

31. The LED signal of claim 29, wherein:

said light transmission surface is angled with respect to a peripheral mounting surface in contact with said housing.

32. The LED signal of claim 29, wherein:

said signal is a 12" nominal size, and said light transmission surface has a spherical shape having an arc radius greater than 24".

33. The LED signal of claim 29, wherein:

said signal is a 8" nominal size, and said light transmission surface has a spherical section having an arc radius greater than 18".

34. The LED signal of claim 29, wherein:

said means for attachment includes means for aligning said distribution cover on said housing in a desired orientation.

35. The LED signal of claim 29, further comprising:

sealing means to environmentally seal said LED signal.

36. The LED signal of claim 35, wherein:

said sealing means is an o-ring.

37. The LED signal of claim 29, wherein:

said means for attachment is at least one connection tab on said distribution cover arranged and configured to mate with a corresponding tab socket on said housing.

38. The LED signal of claim 37, wherein:

said tab socket includes a tab socket key arranged and configured to mate with a corresponding cavity in said connection tab.

39. The LED signal of claim 29, wherein:

said housing and said cover are arranged and configured for retro-fitting into a traffic signal having an incandescent light source, optical elements and an incandescent light source reflector, said LED signal sized to fit within a cavity formed by said traffic signal incandescent light source reflector upon removal of said incandescent light source and said optical elements.

40. The LED signal of claim 39, wherein:

an electrical power connection is made by connection to an incandescent light source socket.

41. The LED signal of claim 29, wherein:

said at least one LED is arranged and configured to emit light upon a collimating element positioned between said cover and said at least one LED.

42. The LED signal of claim 41, wherein:

said at least one LED emits light in an overlapping light pattern such that failure or diminished light output of a single LED is not discernable to a viewer of said LED signal.

43. The LED signal of claim 41, wherein:

said collimating element includes collimating zones arranged and configured with respect to the distribution of said LEDs on said PCB.

44. The LED signal of claim 43, wherein:

said collimating zones are arranged in concentric circles.

45. The LED signal of claim 43, wherein:

said collimating zones are arranged in horizontal or vertical rows.

46. The LED signal of claim 43, wherein:

said collimating zones are arranged in arcs and horizontal and/or vertical rows.

47. The LED signal of claim 27, wherein:

said housing has external electrical power connectors comprising:

a cavity in an external end of each external electrical power connector, and a connector cover having a compression element;

upon insertion of a conductor into said cavity said connector cover compression element is frictionally inserted into said cavity thereby holding said conductor securely in said cavity in electrical contact with said electrical connector.

48. The LED signal of claim 27, wherein:

said at least one LED is arranged in at least one substantially circular configuration.

49. The LED signal of claim 27, wherein:

said at least one LED is arranged in at least one substantially linear configuration.

50. The LED signal of claim 27, further comprising:

a light sensing means, a comparator means, and a reference value;

said light sensing means located within said housing, having an output value relative to a light level within said housing;

said comparator means comparing said output value to said reference value;

if said output value is below said reference value said comparator initiates a disablement means.

* * * * *